US007794377B2

(12) United States Patent
Amzallag et al.

(10) Patent No.: US 7,794,377 B2
(45) Date of Patent: Sep. 14, 2010

(54) PUSH-UP PRESS

(76) Inventors: Didier Amzallag, 122 Gold Kettle Dr., Gaithersburg, MD (US) 20878; Igor Goldman, 19700 Greenside Ter., Montgomery Village, MD (US) 20886

( * ) Notice: Subject to any disclaimer, the term of this patent is extended or adjusted under 35 U.S.C. 154(b) by 0 days.

(21) Appl. No.: 11/901,153

(22) Filed: Sep. 13, 2007

(65) Prior Publication Data

US 2008/0070764 A1 Mar. 20, 2008

Related U.S. Application Data

(60) Provisional application No. 60/844,685, filed on Sep. 15, 2006.

(51) Int. Cl.
*A63B 21/04* (2006.01)

(52) U.S. Cl. ..... 482/141; 482/44; 482/104; 482/108; 482/129

(58) Field of Classification Search ..... 482/129, 482/44–48, 108, 141
See application file for complete search history.

(56) References Cited

U.S. PATENT DOCUMENTS 818,242 A * 4/1906 Geisel ..... 482/128
1,518,361 A * 12/1924 Ruden ..... 482/128
1,548,849 A * 8/1925 Ruden ..... 482/128
1,956,498 A * 4/1934 Hare Duke John Reginald . 482/126
2,920,418 A * 1/1960 Britt ..... 446/241
3,228,392 A * 1/1966 Speyer ..... 601/108
3,544,106 A * 12/1970 Barrett ..... 482/126
3,741,539 A * 6/1973 Hutchins et al. ..... 482/126
3,756,597 A * 9/1973 Monti ..... 482/106
3,761,083 A * 9/1973 Buchner ..... 482/126
3,938,803 A * 2/1976 Wilmoth et al. ..... 482/132
3,971,255 A * 7/1976 Varney et al. ..... 482/114
3,985,354 A * 10/1976 Schulkin ..... 482/123
3,992,004 A * 11/1976 Feron et al. ..... 482/128
4,037,839 A * 7/1977 Nelson ..... 463/47.7
4,111,417 A * 9/1978 Gardner ..... 482/128
4,211,404 A * 7/1980 Blowsky et al. ..... 482/128
4,334,678 A * 6/1982 Doyel ..... 482/128
4,351,527 A * 9/1982 Crisp, Jr. ..... 482/122
4,433,683 A * 2/1984 McCoy et al. ..... 601/120
4,619,454 A * 10/1986 Walton ..... 482/128
4,695,049 A * 9/1987 Ciemiega ..... 482/46
4,775,149 A * 10/1988 Wilson ..... 482/126
4,801,137 A * 1/1989 Douglass ..... 482/82
4,826,151 A * 5/1989 Nuredin ..... 482/68
4,913,417 A * 4/1990 Francu ..... 482/45
4,978,122 A * 12/1990 Dibowski ..... 482/106
5,022,648 A * 6/1991 Travis ..... 482/126
5,046,726 A * 9/1991 Van Straaten ..... 482/125
5,152,731 A * 10/1992 Troutman ..... 482/106
5,154,685 A * 10/1992 Chen ..... 482/126
5,236,169 A * 8/1993 Johnsen ..... 248/561
5,242,349 A * 9/1993 Reiff et al. ..... 482/106
5,257,964 A * 11/1993 Petters ..... 482/92
5,267,929 A * 12/1993 Chen ..... 482/128

(Continued)

*Primary Examiner*—Steve R Crow
*Assistant Examiner*—Robert F Long
(74) *Attorney, Agent, or Firm*—Ilya Zborovsky

(57) ABSTRACT

A push-up device has at least one tubular element, a spring means located inside the tubular element and providing a spring resistance, and a handle associated with the tubular element and a movable by a user against the spring resistance applied by the spring to provide exercising for a user.

15 Claims, 25 Drawing Sheets

U.S. PATENT DOCUMENTS 5,290,209 A * 3/1994 Wilkinson ..... 482/38
5,295,935 A * 3/1994 Wang ..... 482/130
5,328,433 A * 7/1994 Berman ..... 482/122
5,334,118 A * 8/1994 Dantolan ..... 482/93
5,403,269 A * 4/1995 Kennedy ..... 602/36
5,421,800 A * 6/1995 Mullen ..... 482/121
5,474,511 A * 12/1995 Dantolan ..... 482/93
5,551,674 A * 9/1996 Johnsen ..... 267/168
5,605,524 A * 2/1997 Husted ..... 482/112
5,643,160 A * 7/1997 Huang ..... 482/126
5,643,162 A * 7/1997 Landers et al. ..... 482/131
5,755,646 A * 5/1998 Chu ..... 482/118
5,830,110 A * 11/1998 Fielding ..... 482/44
5,913,756 A * 6/1999 Glaser ..... 482/128
5,921,902 A * 7/1999 Carpenter ..... 482/139
5,980,432 A * 11/1999 Ahman ..... 482/77
6,309,329 B2 * 10/2001 Conner ..... 482/125
6,328,680 B1 * 12/2001 Shifferaw ..... 482/132
6,346,065 B1 * 2/2002 Lapointe ..... 482/77
6,352,494 B2 * 3/2002 McAlonan ..... 482/77
6,390,956 B1 * 5/2002 Seelye et al. ..... 482/77
6,468,190 B1 * 10/2002 Fazio et al. ..... 482/112
D470,201 S * 2/2003 Paull ..... D21/692
6,609,995 B1 * 8/2003 Kurz ..... 482/121
6,659,920 B1 * 12/2003 Kurz ..... 482/121
6,663,076 B1 * 12/2003 Tsai ..... 248/575
6,976,943 B1 * 12/2005 Hsiung ..... 482/141
7,115,079 B2 * 10/2006 Yu ..... 482/126
7,134,987 B2 * 11/2006 Goldstein ..... 482/141
7,285,079 B2 * 10/2007 Mandell ..... 482/126
7,326,153 B2 * 2/2008 Bond ..... 482/92
7,438,673 B1 * 10/2008 Jones ..... 482/71
7,462,140 B1 * 12/2008 Lombardozzi ..... 482/82
7,645,218 B2 * 1/2010 Potok ..... 482/141
2004/0152571 A1 * 8/2004 Udwin ..... 482/128
2004/0180766 A1 * 9/2004 Guinn ..... 482/126
2005/0101457 A1 * 5/2005 Tuller ..... 482/128
2006/0030464 A1 * 2/2006 Udwin ..... 482/126
2006/0270534 A1 * 11/2006 Adcock et al. ..... 482/128
2007/0010375 A1 * 1/2007 Corte ..... 482/41
2008/0070764 A1 * 3/2008 Amzallag et al. ..... 482/129

* cited by examiner 49
50
44
38
31
54
39
47
54
44
45
46
29
54
54
28
30
27

34
44
44
38
31
47
39
34
44

34
44
44
35
38
31
37
37
47
39
36
36
34
44
44

40
42
43
41
34
27
40
42
43
41

34
44
38
44
43
42
37
37
35
36
36
47
48
39
34
43
42
44
44

PUSH-UP PRESS

CROSS-REFERENCE TO A RELATED APPLICATION

The invention is based on provisional application Ser. No. 60/844,685 filed on Sep. 15, 2006 which is a basis for priority of this application.

BACKGROUND OF THE INVENTION

The present invention relates to exercising devices. More particular, it relates to exercising devices for assisting individuals in performing a motion of a floor push-up.

It is believed that there is a need for a device which helps to improve building of a chest, arms, legs, shoulders, back and core muscles of an individual. The device in accordance with the present invention is designed for this particular objective.

SUMMARY OF THE INVENTION

Accordingly, it is an object of the present invention to provide a device for assisting individuals to adequately perform a motion of a floor push-up with the capabilities of duplicating the motion of a dumbbell press on flat bench.

In keeping with these objects and with others which will become apparent hereinafter, one feature of the present invention resides, briefly stated, in a push-up device, comprising at least one tubular element; spring means located inside said tubular element and providing a spring resistance; and handle means associated with said tubular element and movable by a user against the spring resistance applied by said spring means to provide exercising for a user.

When the push-up press is designed in accordance with the present invention, it assists individuals to perform adequately a motion of a floor push-up with some assistance, or also called in the fitness terms, Spotting.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
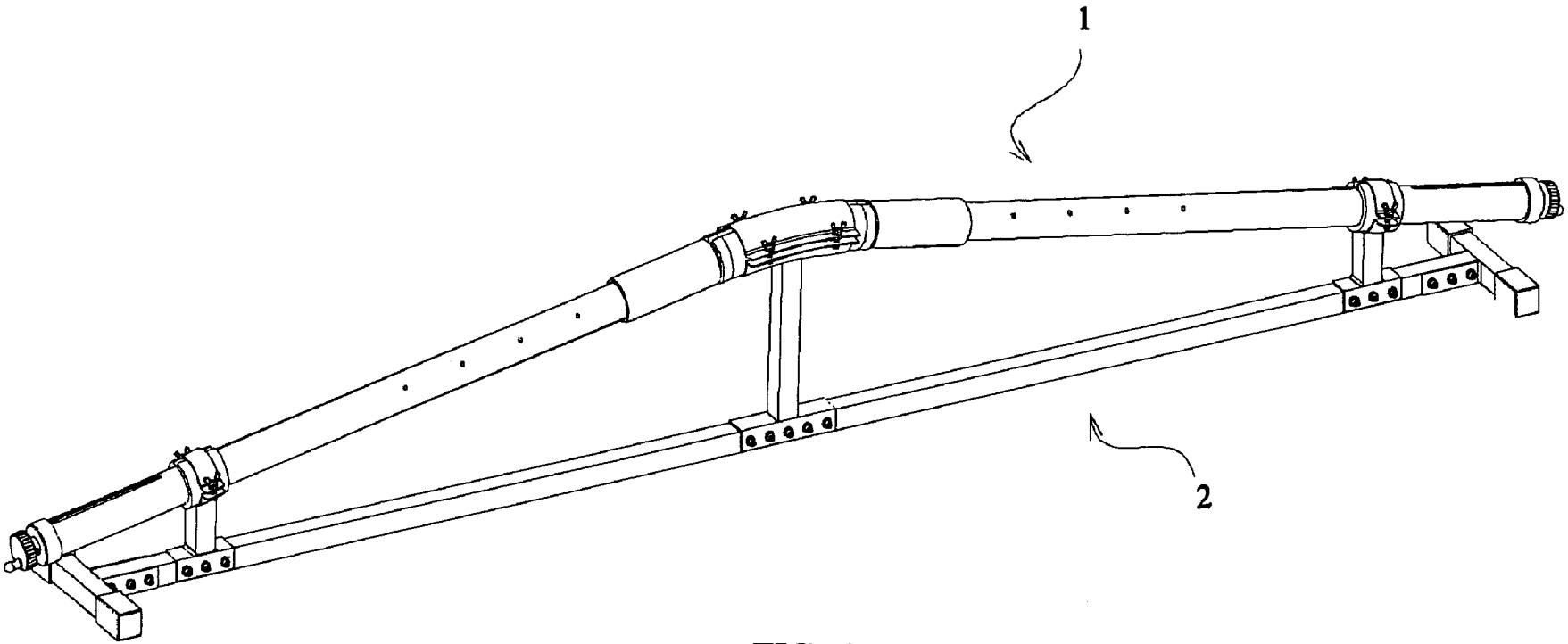
FIG. 1 is a view showing an assembled push-up press in a perspective view in accordance with the present invention.
Figure 2:
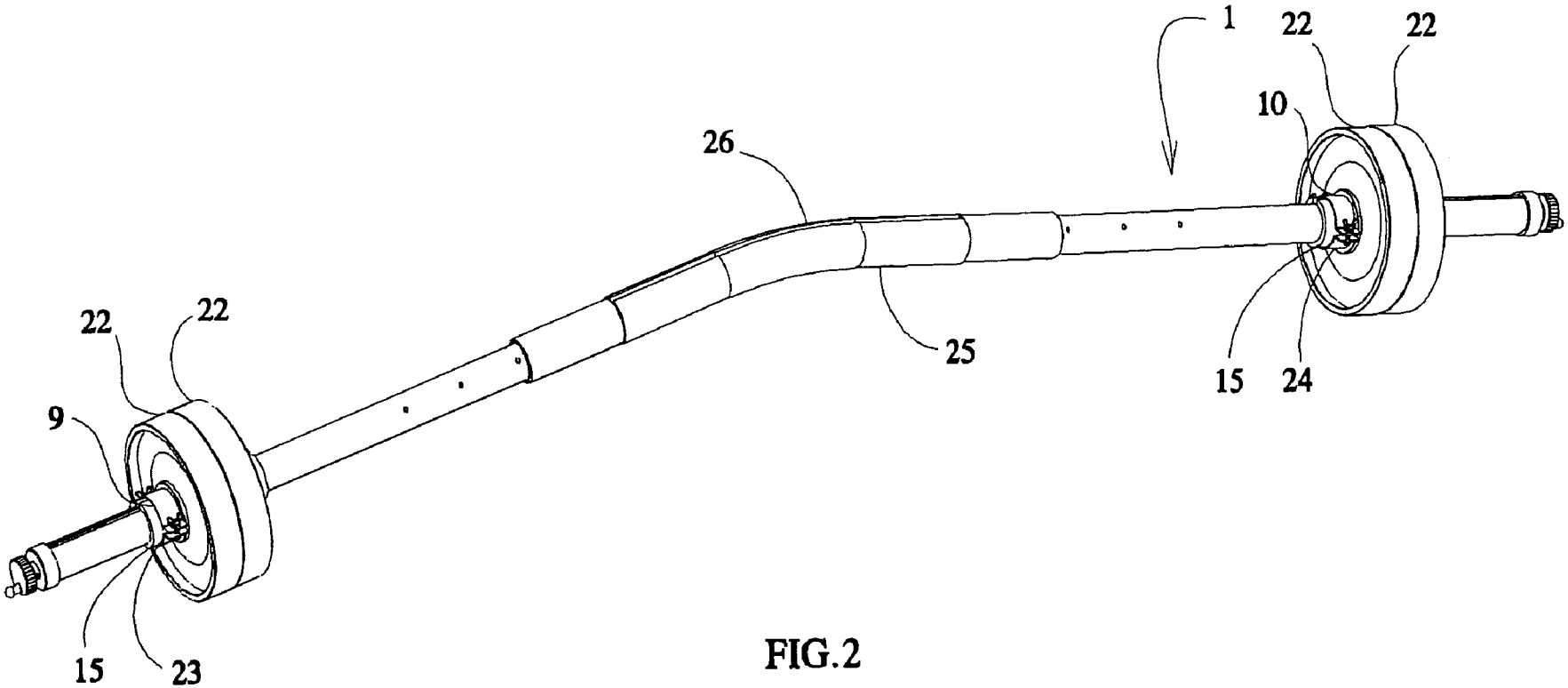
FIG. 2 is a view showing a stand-alone arm with weights on each end in a perspective view in accordance with the present invention.

A push-up-press in accordance with the present invention as shown in FIG. 1 has a bar 1, which is slightly bent from its center and secured on a strong base 2 in order to elevate the bar 1 from the floor to adequately perform the motion. There are vertical supports 3 and 4 on each end of the base 2 and a central vertical support 5 to create stability to the push-up-press, so that it does not tilt on either side once the user exercises on this device.

Figure 3:
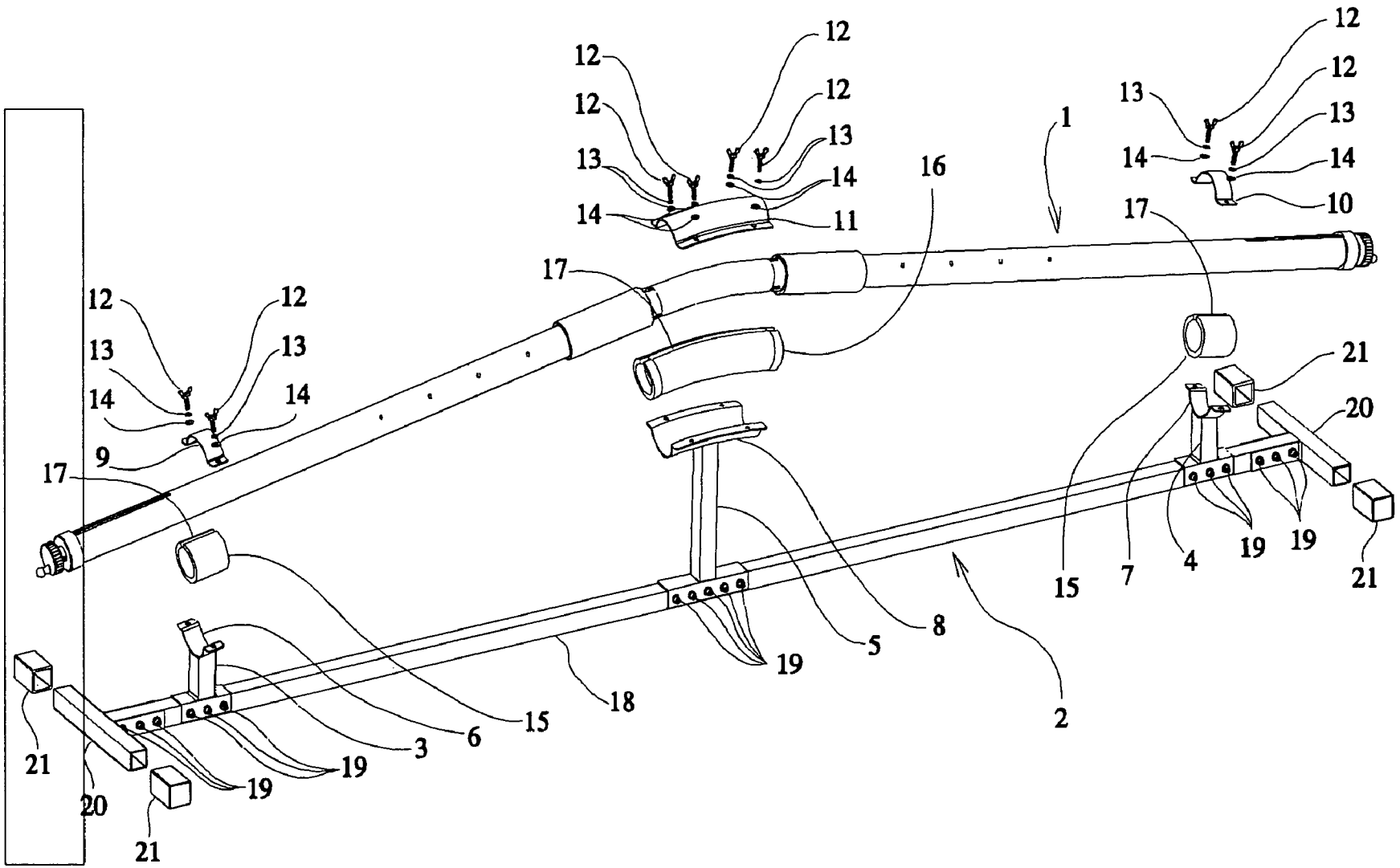
FIG. 3 is an exploded view of the inventive push-up press shown in FIG. 1.
Figure 4:
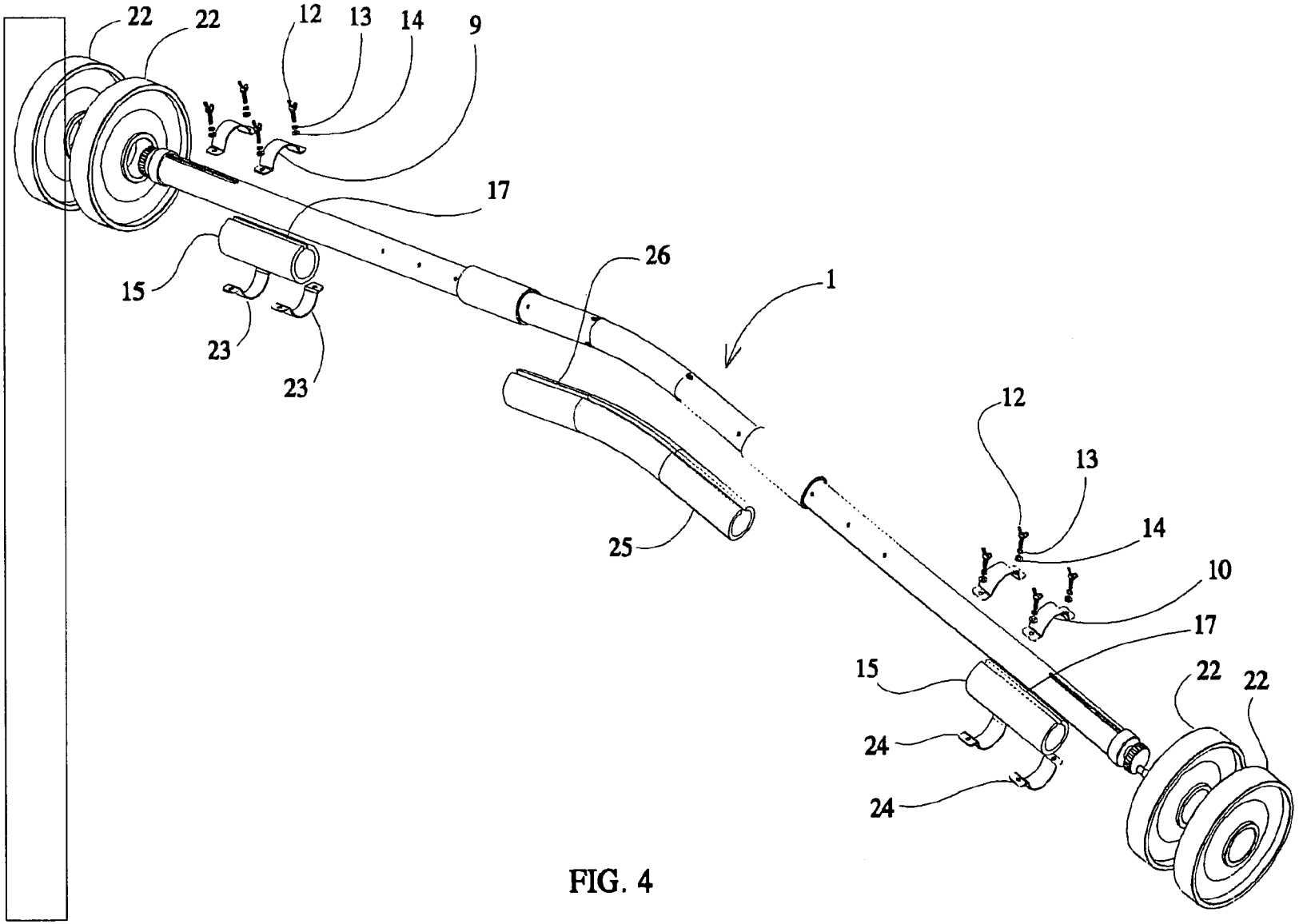
FIG. 4 is an exploded view of a stand-arm with weights shown in FIG. 2.
Figure 5:
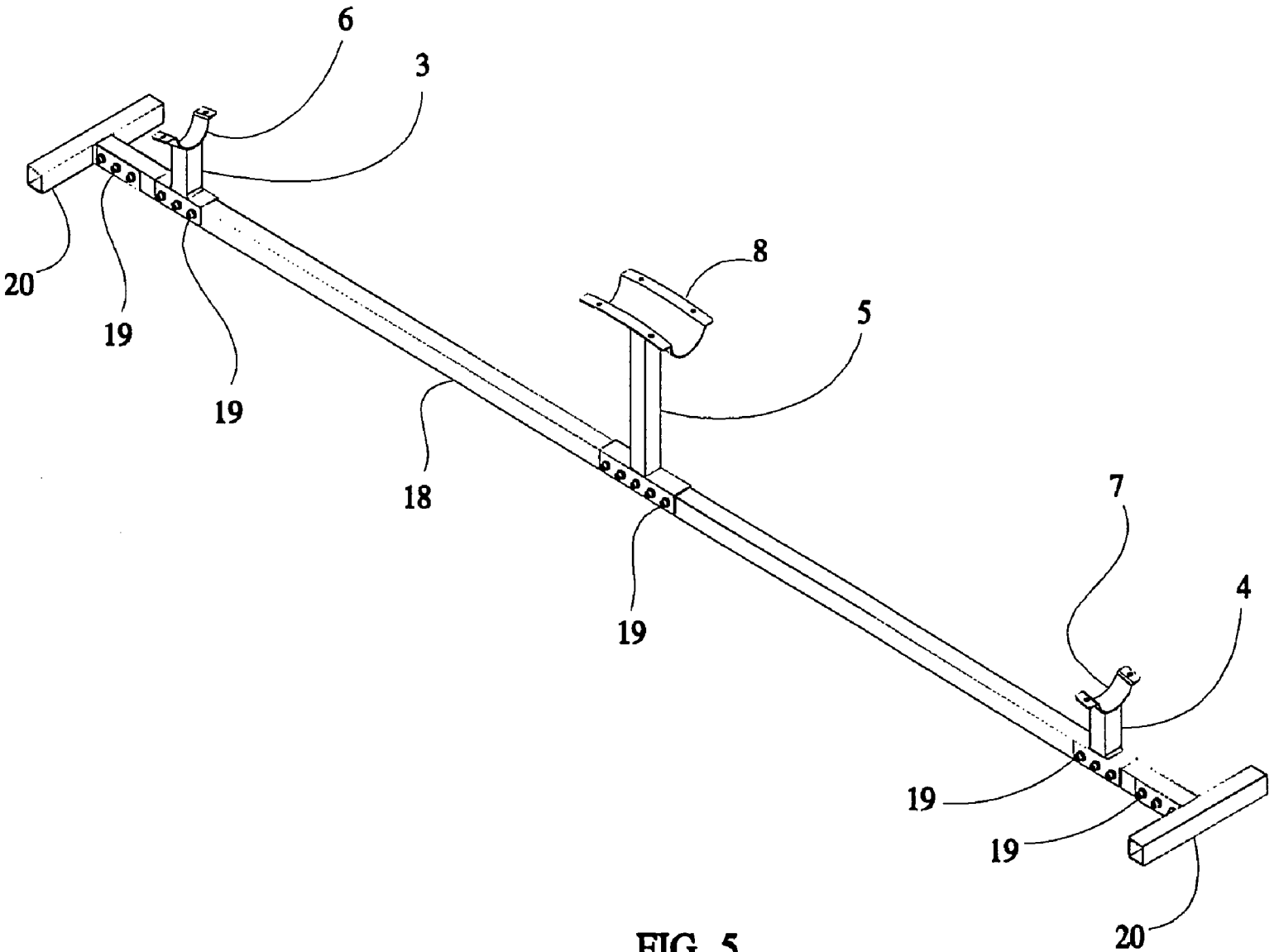
FIG. 5 is a view showing an assembled stand-alone base for a push-up press in a perspective view.
Figure 6:
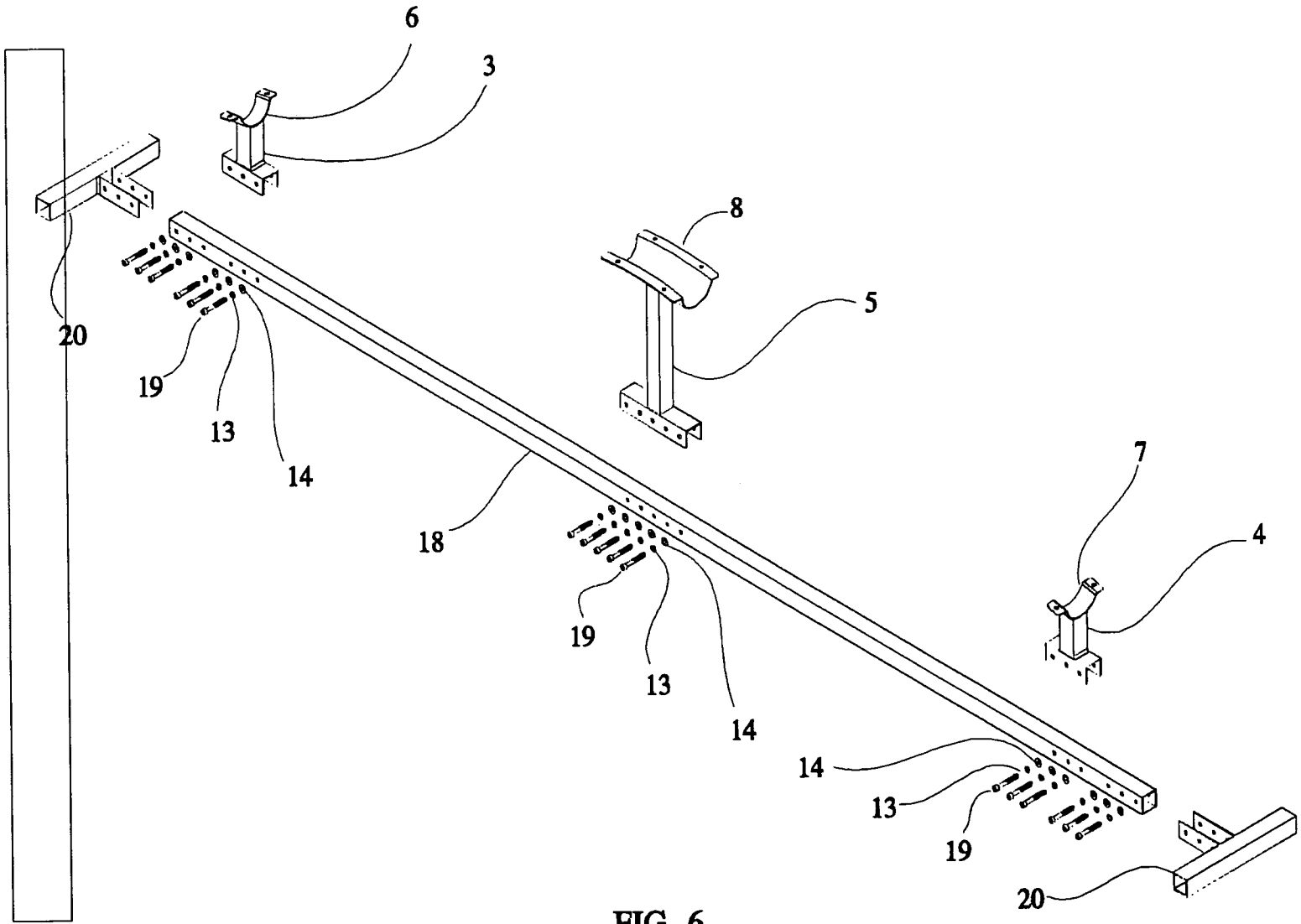
FIG. 6 is an exploded view of the base for the push-up press shown in FIG. 5.

The bar 1 is supported in on the base 2 by welded supports 3 and 4 with bottom clamps 6 and 7 and welded central support 5 with a clamp 8. Top clamps 9, 10 and 11 secure the bar 1 to the bottom clamps 6, 7 and 8 respectively with wind screws 12, lock washers 13 and flat washers 14, as shown in FIG. 3. The wind screws 12 are used for quick and easy release of the bar 1 from the base 2.

Rubber spacers 15 and 16 are installed on the bar 1 between the bottom clamps 6, 7, 8 and the top clamps 9, 10, 11. Each spacer 15 and 16 has a cut 17 for easy installation of the rubber spacers 15 and 16 on the bar 1. The rubber spacers 15 and 16 are used to increase friction between the metal bar 1 and metal clamps 6, 7, 8, 9, 10, 11, adding more safety to the push-up-press by eliminating a risk of sliding off of the bar 1.

The vertical supports 3, 4 and 5 are secured to a rectangular bar 18 with screws 19, lock washers 13 and flat washers 14, as shown in FIG. 1, 3, 5, 6.

The rectangular bar 18 is connected on its ends with identical horizontal supports 20 by screws 19, lock washers 13 and flat washers 14, as shown in FIG. 1, 3, 5, 6. The horizontal supports 20 are used to impart to the entire base 2 with the bar 1 the needed stability within an exercise time and a space-saving advantage for in transportation to a store, or to a customer's home. Rubber caps 21, shown in FIGS. 1 and 3, attached to the ends of horizontal supports 20, operate as end plugs and as extra spacers to increase friction between the floor and base 1.

The entire base 2 represents our assembly with the vertical supports 3, 4, 5, bottom clamps 6,7,8, top clamps 9, 10, 11, wind screws 12, lock washers 13, flat washers 14, rubber spacers 15, 16 with cuts 17, rectangular bar 18 with screws 19, lock washers 13, flat washers 14, horizontal supports 20 and rubber cups 21.

The stand-alone base 2 is designed for easy assembly and disassembly. A customer needs simple tools to assemble the base 2. This aspect is mostly used for packing reasons, since a manufacturer wants to use a smaller box to ship the device, and if it comes fully assembled, the box will be large, hence more expensive to ship and package. The whole base 2 is fully dismantled at the customer home and could be reassembled with the use of simple instructions.

The stand-alone bar 1 can be used with weights 22, shown in FIG. 2, 4, 15A, 15B and without weights 22. The stand-alone bar 1 can be used for exercising, including barbell biceps ez-curl, squat, triceps press, skull crushers (triceps exercise), shoulder press. Adding some weight on each side increases resistance to the bar 1. The top clamps 9, 10 and bottom clamps 23 and 24 are provided to lock the weights 22, with the rubber spacers 15. A rubber spacer 25 differs from the rubber spacer 16, used to lock bar 1 to the base 2. The rubber spacer 25 with a cut 26 is provided for the soft contact bar 1 (with or without weights 22) to exercised a person's neck and to limit hands motion. The cut 26 is used for easy installation rubber spacer 25 on the bar 1.

Figure 13A:
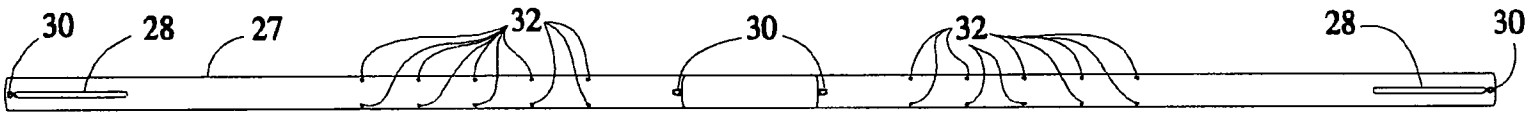
FIG. 13A is a top view of the bar of the inventive push-up press.
Figure 13B:
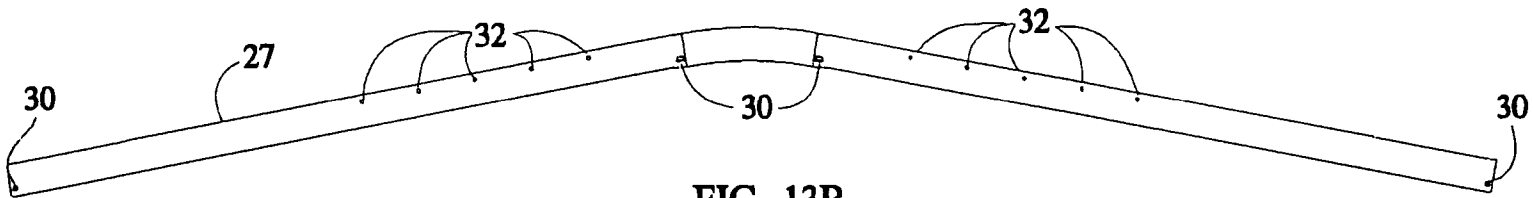
FIG. 13B is a front view of the bar of the inventive push-up press.
Figure 13C:
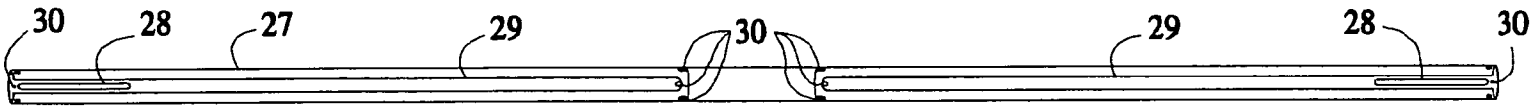
FIG. 13C is a bottom view of the bar of the inventive push-up press.
Figure 14A:
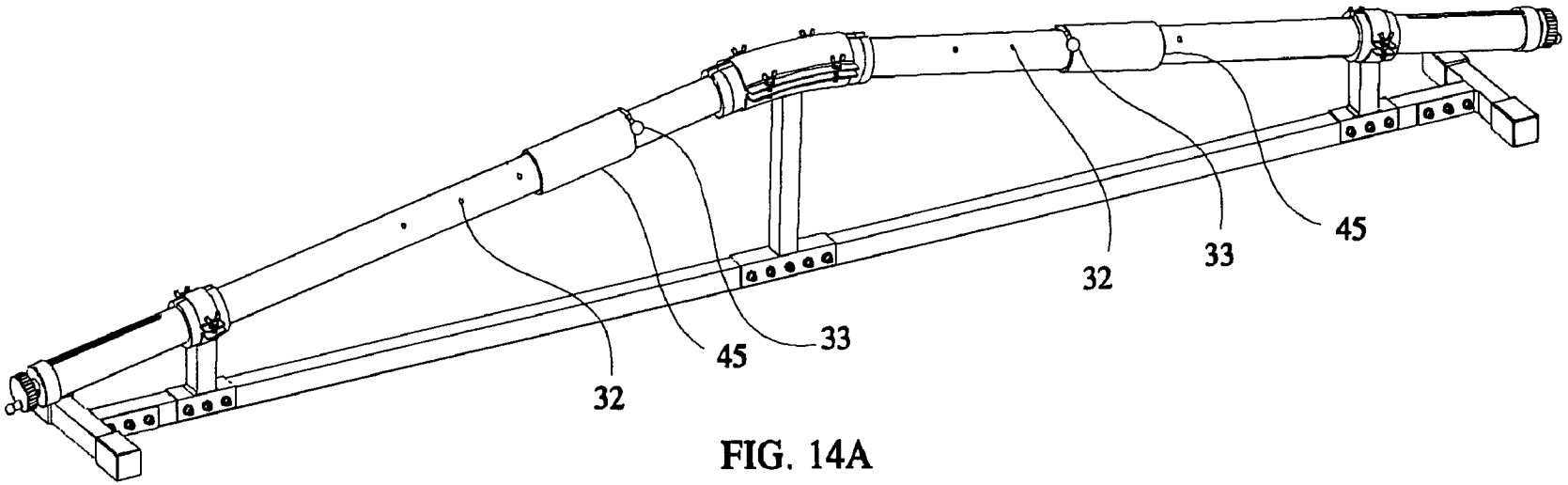
FIG. 14A is a view showing an assembled push-up press in a perspective view in accordance with the present invention with two pins installed.
Figure 14B:
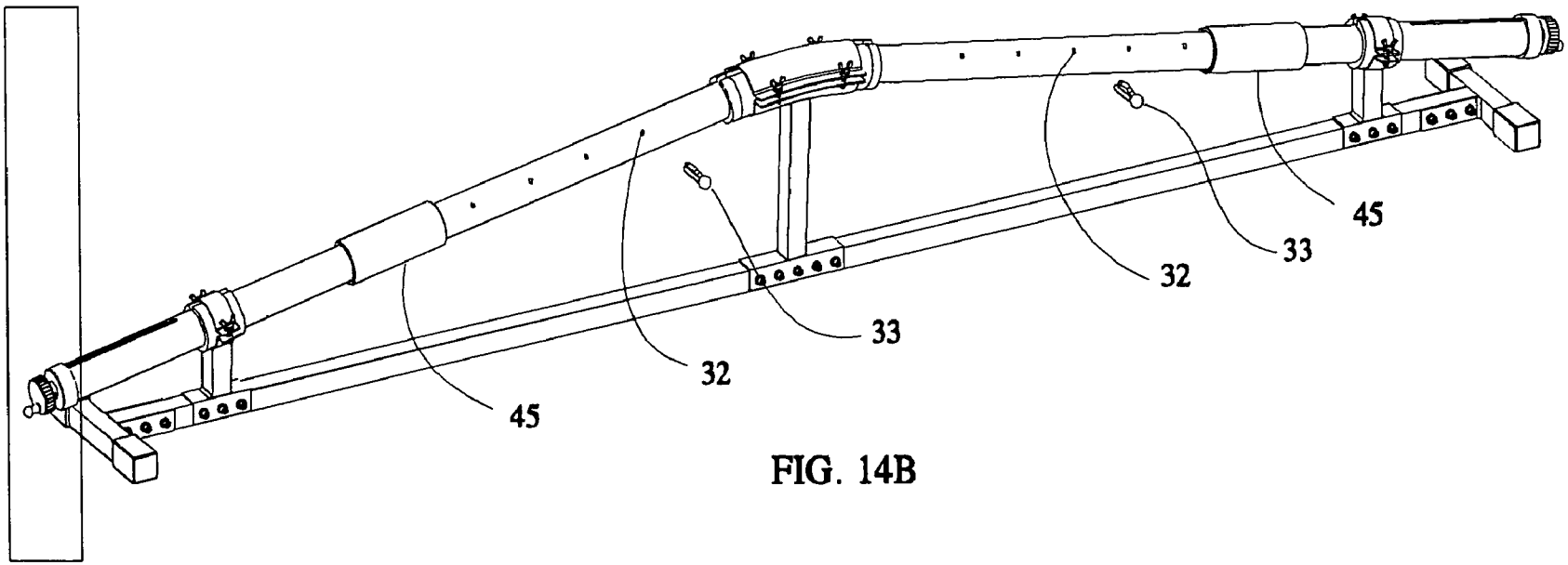
FIG. 14B is a view showing the assembled push-up press in a perspective view in accordance with the present invention, with the two pins installed, and the pins exploded.
Figure 15A:
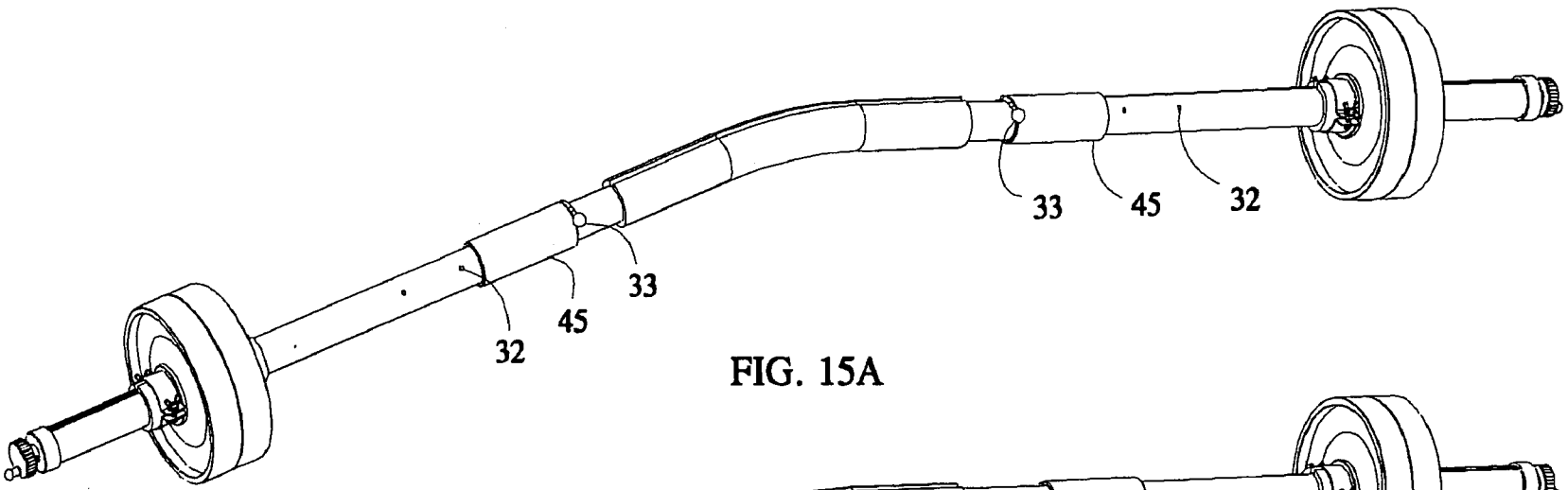
FIG. 15A is a view showing the stand-alone bar with weights on each end in a perspective in accordance with the present invention, shown in FIG. 2 with two pins installed.
Figure 15B:
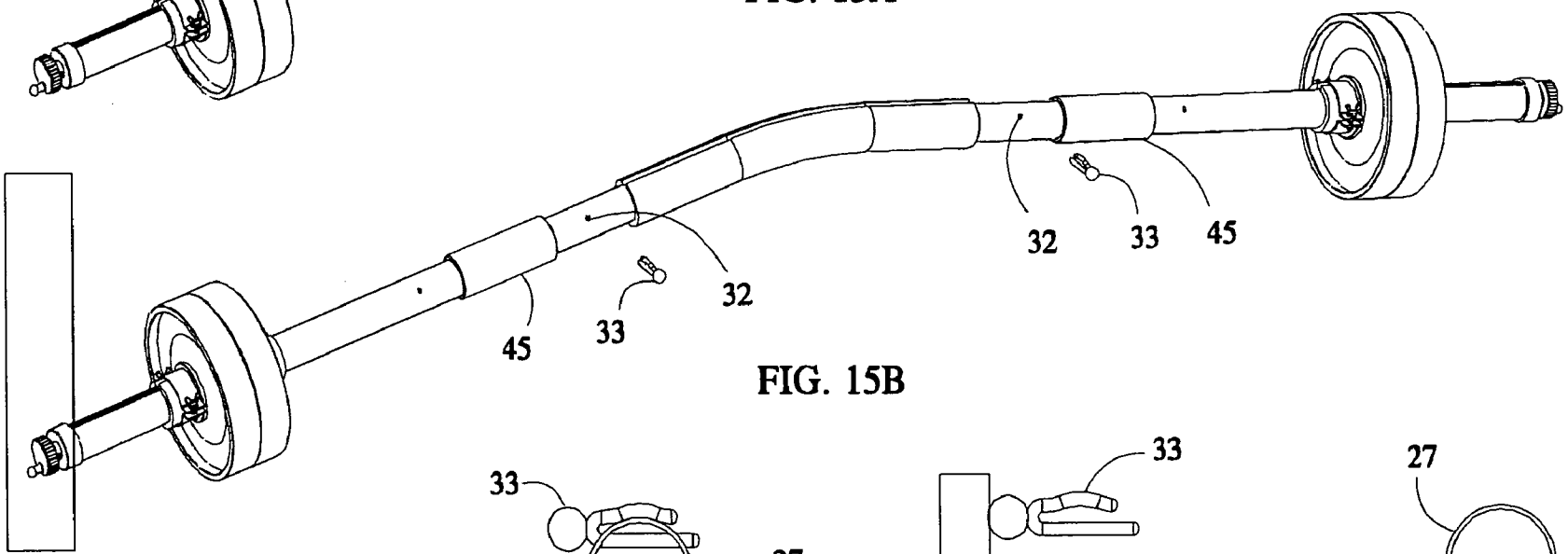
FIG. 15B is a view showing the stand-alone bar with weights on each end with a perspective view in accordance with the present invention shown in FIG. 15A with two pins installed, and the pins exploded.
Figure 16B:
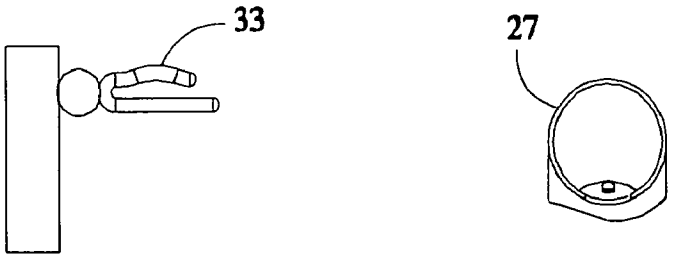
FIG. 16B is a view showing a sample of the pin installation to the bar, shown in FIG. 16A, exploded view.
Figure 16A:
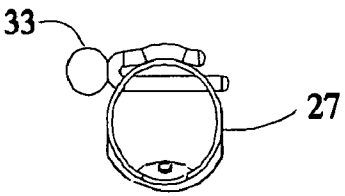
FIG. 16A is a view showing a sample of the pin installation to the bar.

The bar 1 represents the main assembly. It has a standard metal tube 27, slightly bended from its center origin, see FIG. 10A-10G, 13B. The right and left hand side of the tube 27 has small linear openings 28, located in the top mid-section on either side of the tube 27, shown in FIG. 13A. The right and left hand side of the tube 27 has longer and wide linear openings 29, located in the bottom mid-section on either side of the tube 27, shown in FIG. 13C. The right and left hand side of the tube 27 has also array of holes 30 needed for two assemblies 31 installation and securing these assemblies 31 inside the tube 27. Holes 30, such as openings 28 and 29, are shown in FIGS. 13A, 13B and 13C. The right and left hand side of the tube 27 also has array of holes 32 needed for pin 33 installation.

Each assembly 31 has two end point clamps 34, holding a lead screw 35 and two guiding shafts 36. On the guiding shafts 36 there are located two loaded springs 37, a sliding plate 38 on the one hand and a sliding handle support 39 on the other hand. The end point clamp 34 has cutouts 40 and gaps 41 a for screw 42 and lock washer 43 installation to secure the guiding shafts 36. A cylindrical shape of the end point clamp 34 with cutouts 40 is provided to prevent interference of the entire assembly 31 with an inner cylindrical surface of the tube 27 during installation, see FIG. 7, 8A, 8B, 8C, 9.

Figure 11:
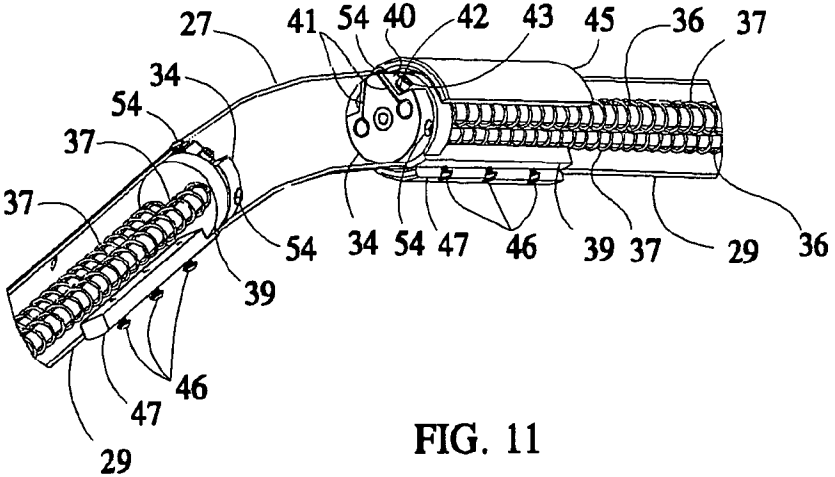
FIG. 11 is a partial perspective view of a top of the push-up press with a sectional bar opening.

On the cylindrical surface of the end point clamp 34 there are located threaded holes 44, which are aligned with holes 30 on the tube 27 in the installed position. Handles 45 are secured to handle supports 39 with screws 46 and are installed on the inner surface of tube 27 with the possibility to slide along the tube 27. Each handle support 39 has an extended protrusion 47 with threaded holes 48 for screws 46. An actuating handle 45 is located on the extended protrusion 47 and secured to it with screws 46, see FIG. 11. The extended protrusion 47 provides the required stability to the handle 45. An outer surface of the extended protrusion 47 is aligned with an outer surface of the tube 27 and represents a support and guide for the handle 45. The extended protrusion 47 is locating in the opening 29 of the tube 27 and has the ability for a linear motion with the handle 45 along the tube 27.

The handle support 39 and the sliding plate 38 are spring-loaded with two springs 37. The sliding plate 38 is threaded like a lead screw 35. If the lead screw 35 is rotated, the sliding plate 38 performs a linear motion toward the handle support 39, compressing two springs 37 and providing additional resistance springs 35 to handle support 39. This is shown on FIG. 10A-10G. In order to rotate the lead screw 35 it is connected at its end with a crank handle 49 and a screw 50, shown on FIG. 12.

Figure 12:
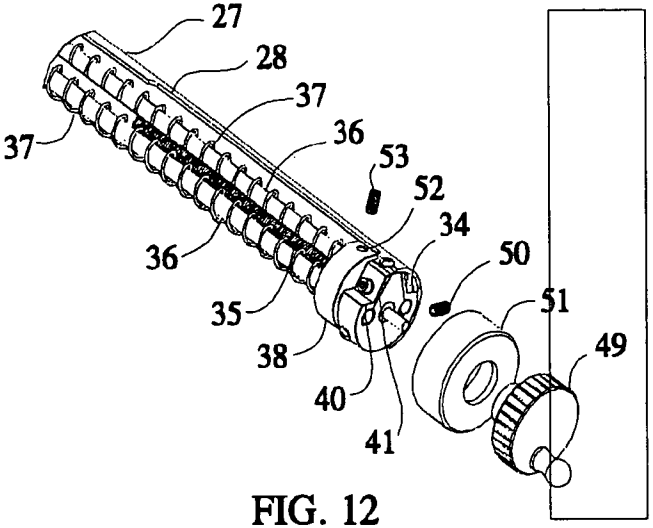
FIG. 12 is a partial perspective exploded view of an end side of the push-up press with a sectional bar opening.

The assemblies 31 and the end of tube 27 are covered with a rubber cover 51, shown on FIG. 12. The sliding plate 38 has a threaded hole 52 with a set screw 53 installed with ability to slide with the sliding plate 38 along the opening 28, shown in FIG. 12. The set screw 53 is visible on the top view of the bar 1 and serves as a tension indicator or a sliding plate 38 locator when the crank handle 49 is rotated.

Figures 7, 8A, 8B, 8C, 9:
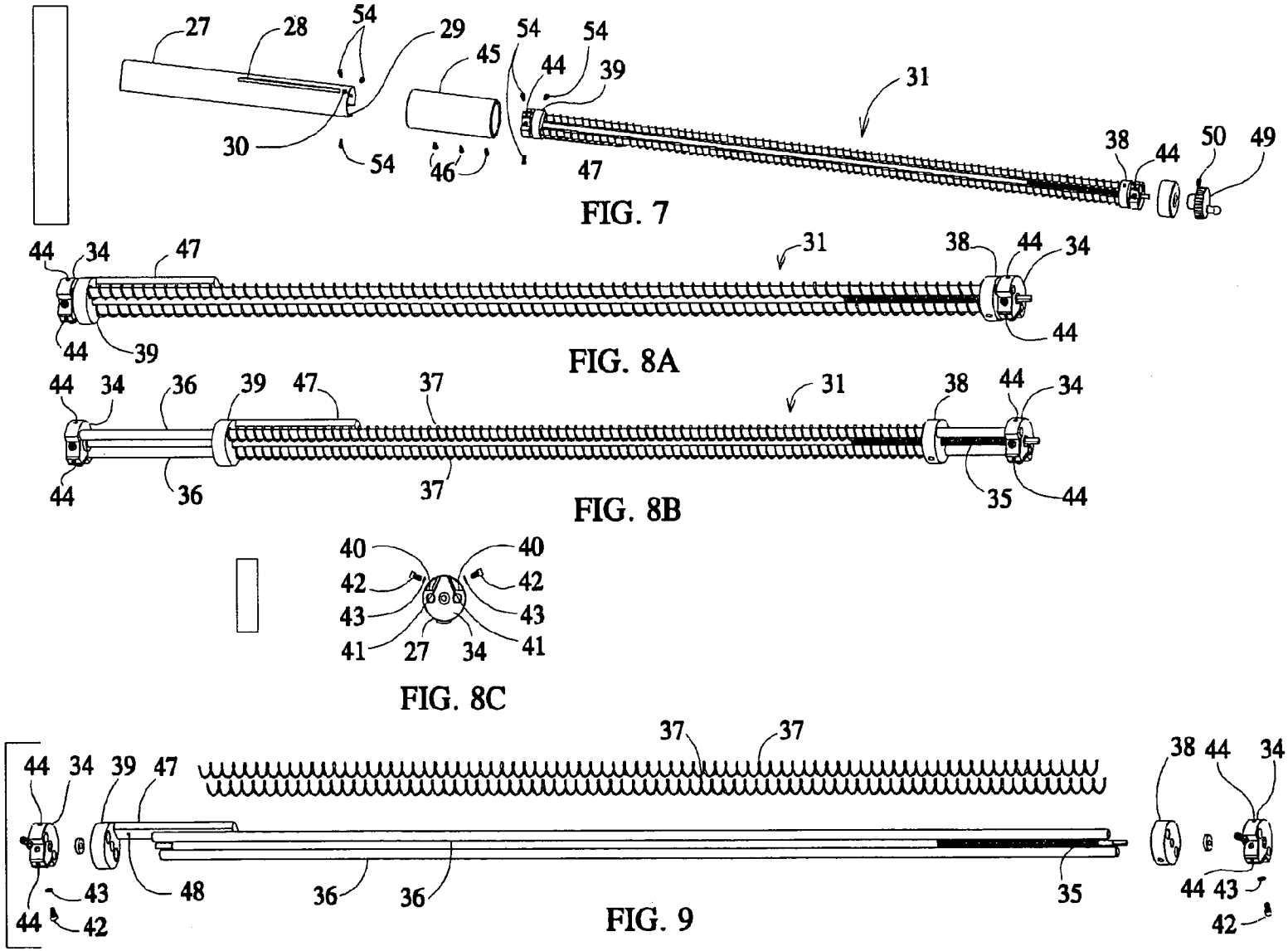
FIG. 7 is a view showing an example of an insertion spring loaded system in one side of a bent bar, partially in a perspective.
FIG. 8A is a view showing the assembled spring-loaded system in a perspective.
FIG. 8B is a view showing a sample of the spring which is partially compressed in both sides, shown in FIG. 8A.
FIG. 8C is a partially exploded sided view of the spring-loaded system shown in FIG. 8A.
FIG. 9 is an exploded view of the spring loaded system, shown in FIG. 8A.

The assemblies 31 installed inside the tube 27 from both sides and covered with the rubber covers 51 are secured to the tube 27 with the screws 54, shown on FIG. 7, 11.

Figure 10A:
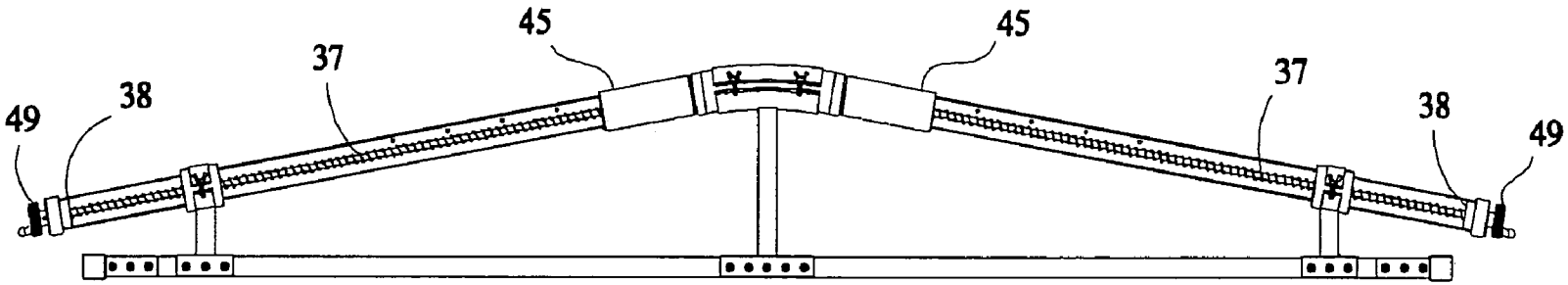
FIG. 10A is a front view of the assembled push-up press in a starting position and a sectional bar cutout.
Figure 10B:
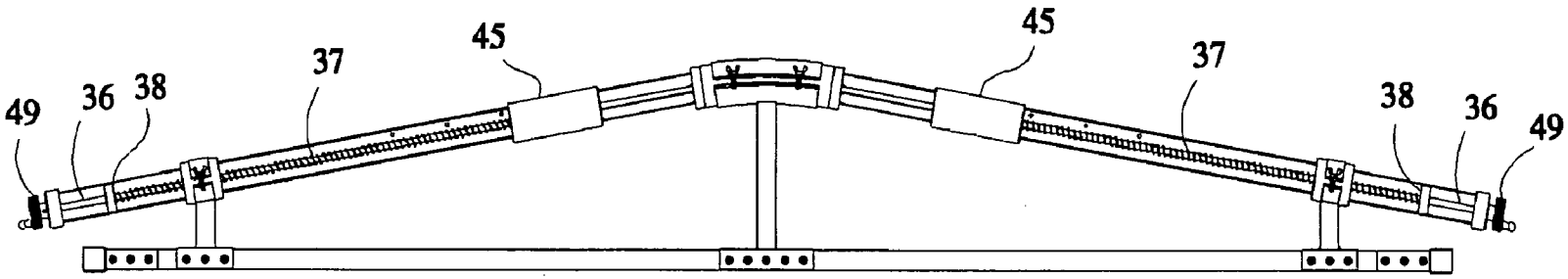
FIG. 10B is a front view of the assembled push-up press in a partially compressed spring by rotating crank handles and partially movable handles.
Figure 10C:
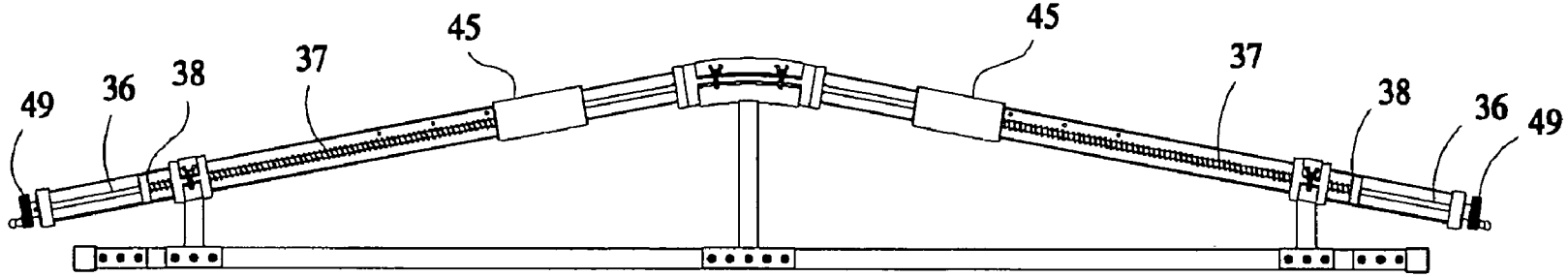
FIG. 10C is a front view of the assembled push-up press with a fully compressed spring by rotating crank handles and partially moved handles.
Figure 10D:
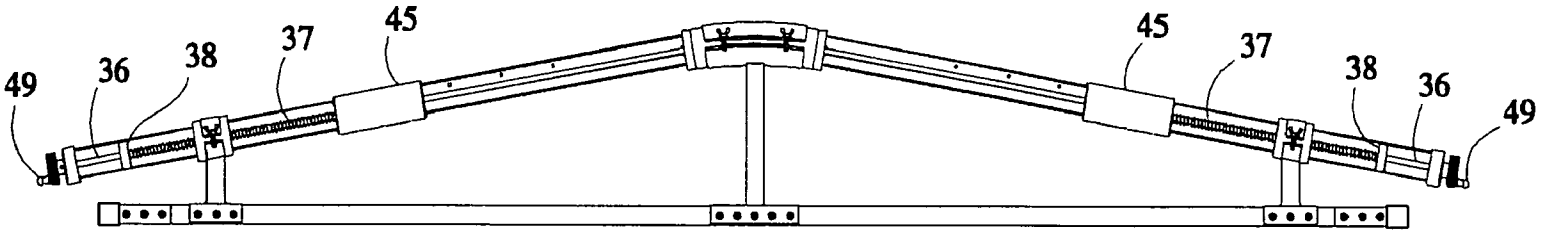
FIG. 10D is a front view of the assembled push-up press with a partially compressed spring by rotating crankhandles and continuously partially moved handles when more pressure is applied to the handles.
Figure 10E:
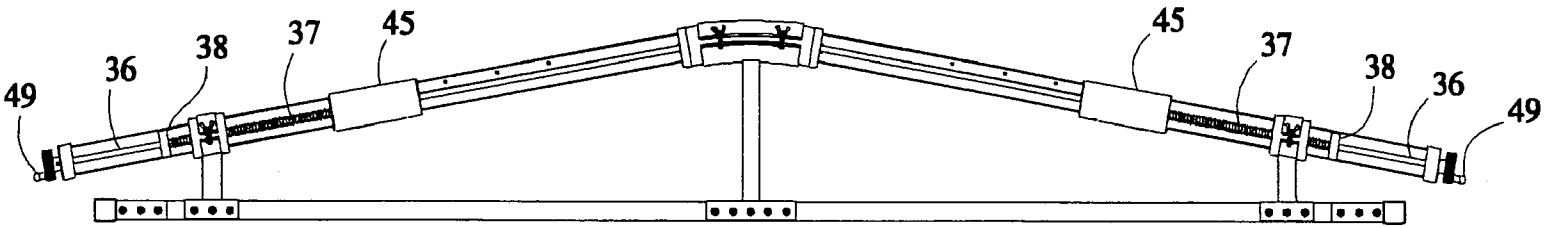
FIG. 10E is a front view, shown in FIG. 10D of the assembled push-up press with a fully compressed spring by rotating crank handles and continuously partially moved handles when more pressure is applied to the handles.
Figure 10F:
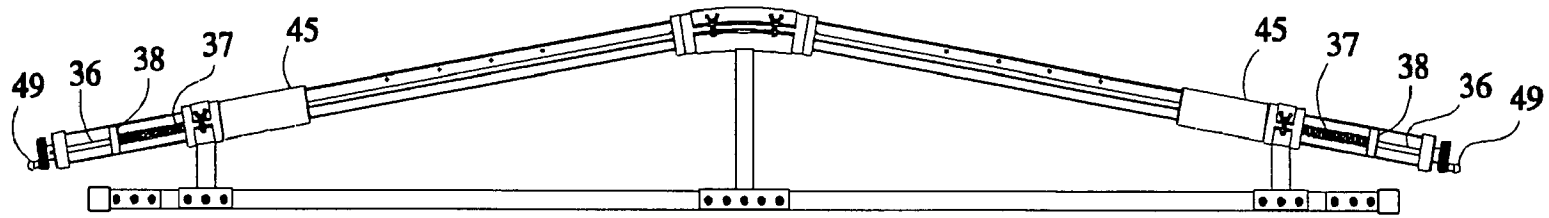
FIG. 10F is a front view of the assembled push-up press shown in FIG. 10D with a partially compressed spring by rotating crank handles and fully removed handles when more pressure applies to handles, with the handles extended to the end point position.
Figure 10G:
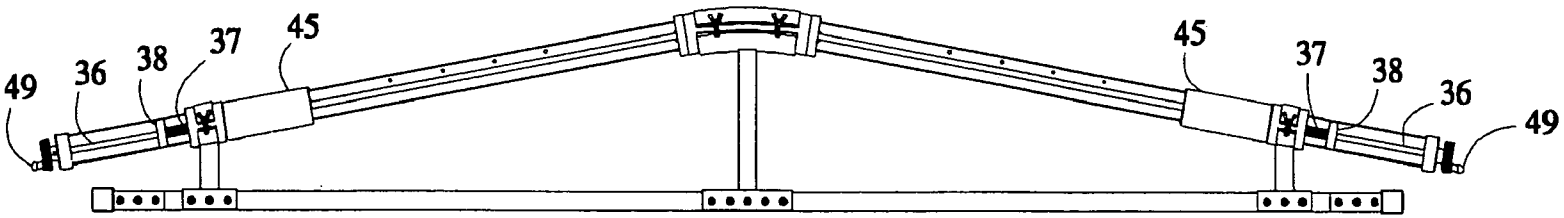
FIG. 10G is a front view, shown in FIG. 10F of the assembled push-up press with the fully compressed spring by rotating crank handles and fully moved handles when maximum pressure applies to the handles, the handles extended to the end point position.

The inventive device operates in the following manner;

FIG. 10A shows a first or starting position, when the handles 45 are not pressed and the crank handles 49 are not rotated. The springs 37 distribute a certain amount of load to the sliding plates 38 and to the handle supports 39 on both sites of the bar 1. FIG. 10B shows midpoint of the motion. The handles 45 are moving on opposite side from each other, one is moving to the right, and the other to the left, creating a tension on the spring system. Also, on both end of the device, the crank handles 49 are rotated to force sliding plates 38 to move and compress springs 37 that generates even more tension, so that the exercise is performed easily, creating pressure so that the springs 37 push back up the handles 45 with a greater force. If a user continues to rotate crank handles 49, the springs 37 will be more compressed by the sliding plates 38 and the force the handles 45 will increase, as shown in FIG. 10C. The more pressure is exercised on the springs 37, the easier will be for the user to perform the push-up. FIG. 10C shows that the crank handle 49 creates the situation that the sliding plates 38 compress the springs 37 aiding in the performance of the push-up without much exertion.

As described above the spring 37 resistance (or sliding plate 38 location) is determined by the set screw (or tension indicator) 53. The spring 37 resistance is adjustable by crank handle 49. If to continue to push handles 45, spring resistance will increase until the springs 37 become fully compressed by the handle supports 39 from one side and by the sliding plates 38 from the other side of each assembly 31, see FIG. 10D-10G. Now the fully compressed springs 37 will help the user to push-up back. If the user needs to limit the push-up motion the optional pin 33 installation could be used.

The device in accordance with the present invention is universal. The bar 1 can be placed on the user's neck without the base 2 with or without the weights 22.

Figures 17A, 17B, 18, 19A, 19B, 19C, 19D:
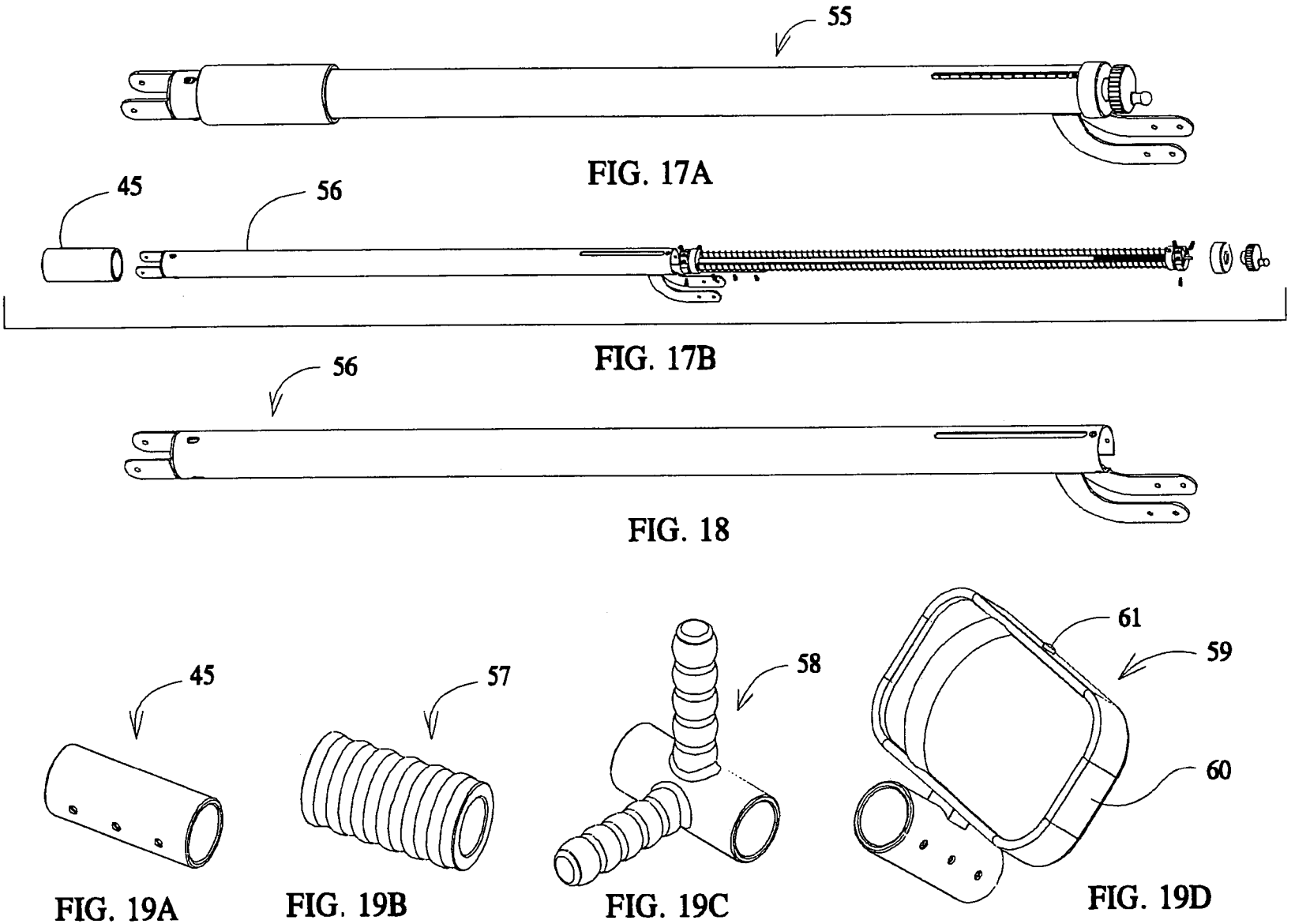
FIG. 17A is a view showing an assembled one-sided bar for one-sided push-up press in a perspective view in accordance with the present invention.
FIG. 17B is an exploded view in the inventive one-sided bar shown in FIG. 17A.
FIG. 18 is a view showing the stand-alone one-sided bar in a perspective view in accordance with the present invention.
FIG. 19A is a view showing a simple handle for a push-up press in accordance with the present invention in accordance with a perspective view.
FIG. 19B is a view showing a handle with a finger grip for the push-up press in accordance with the present invention in the perspective view.
FIG. 19C is a view showing a double-handled device, with two handles normal to one another and arranged on one tube, for the push-up press in accordance with the present invention in a perspective view.
FIG. 19D is a view showing a feet pedal for push-up press in a perspective view.

The bar 1 on present invention can be divided into two separate identical assemblies, which are shown in FIG. 17A and FIG. 17B as a one side bar 55. The main difference between the bar 1 and one sided bar 55 are a tube 27 for the bar 1 and a tube 56 for the one sided bar 55. Openings 28 and 29, and all mechanical parts 34, 35, 36, 37, 38, 39, 40, 41, 42, 43, 45, 46, 49, 50, 51, 53, 54 shown on FIG. 7-FIG. 13C are the same The handle 45 can have different modification, shown in FIG. 19B with a finger grip, or as shown in FIG. 19C as a double handled device, or as shown on FIG. 19D as a feet pedal 59, which represents a feet support 60 installed on a shaft 61.

Figure 20A:
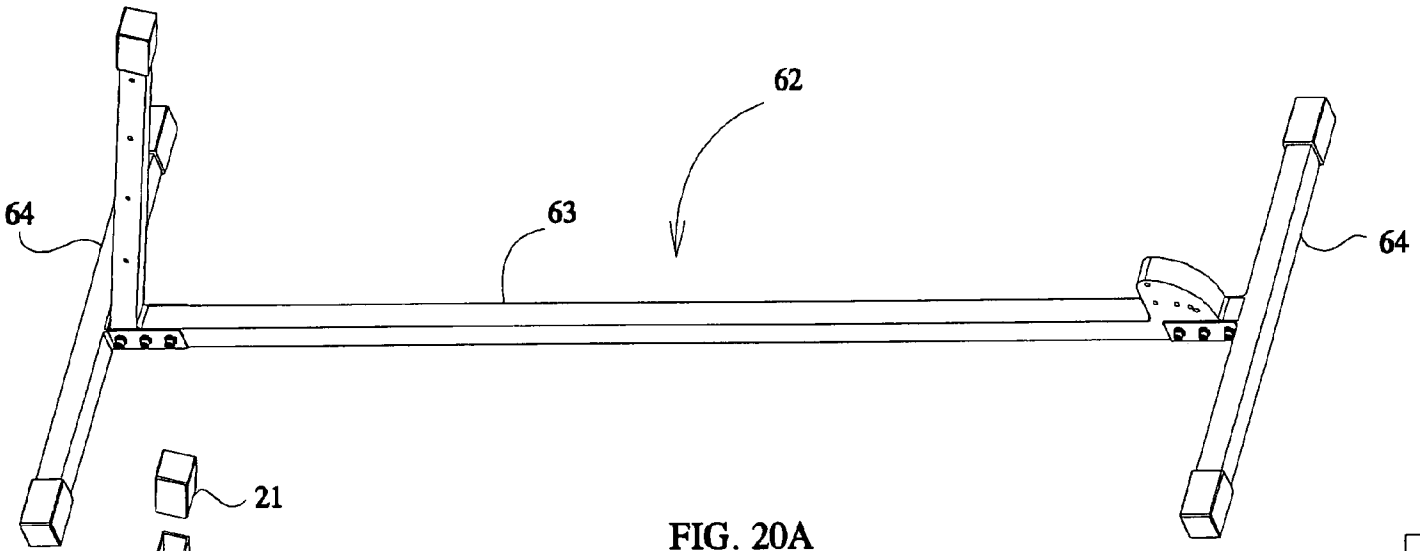
FIG. 20A is a view showing an assembled stand-alone base for one-sided push-up press in a perspective view.
Figure 20B:
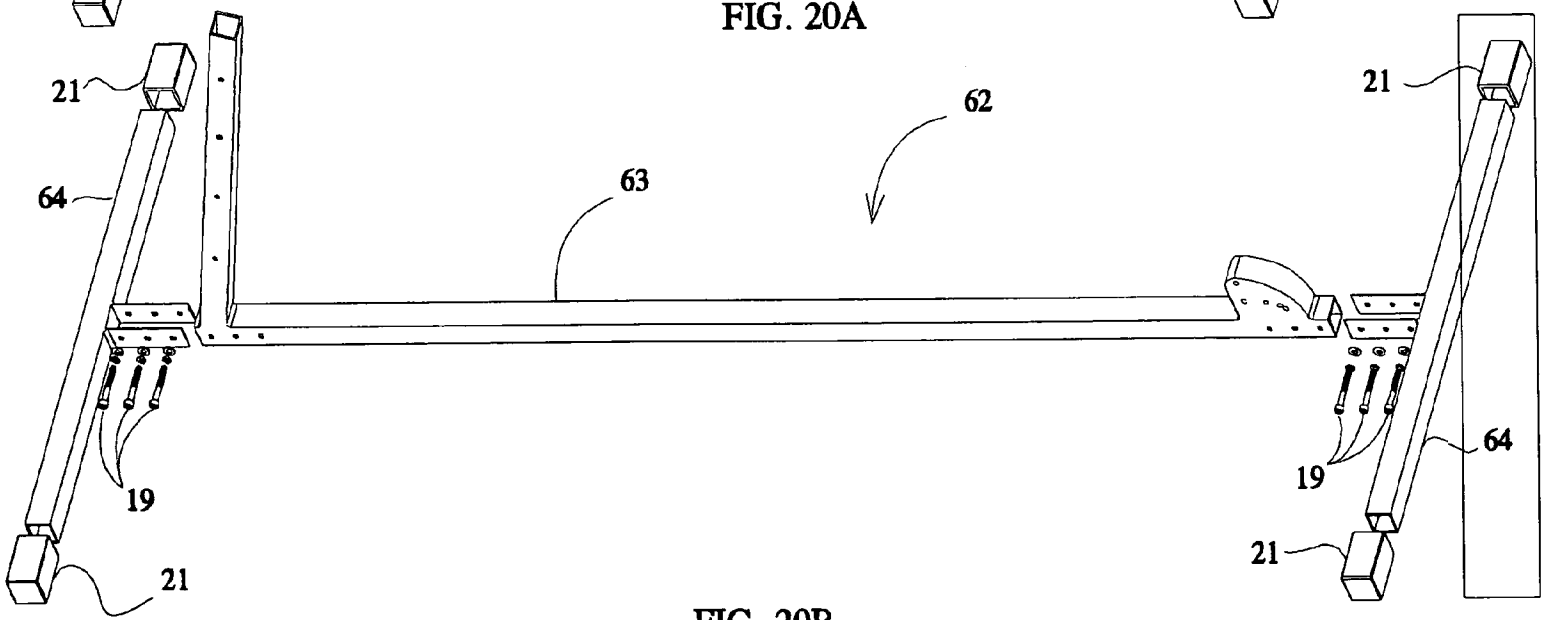
FIG. 20B is an exploded view of a base for one-sided push-up press shown in FIG. 20A.
Figure 21A:
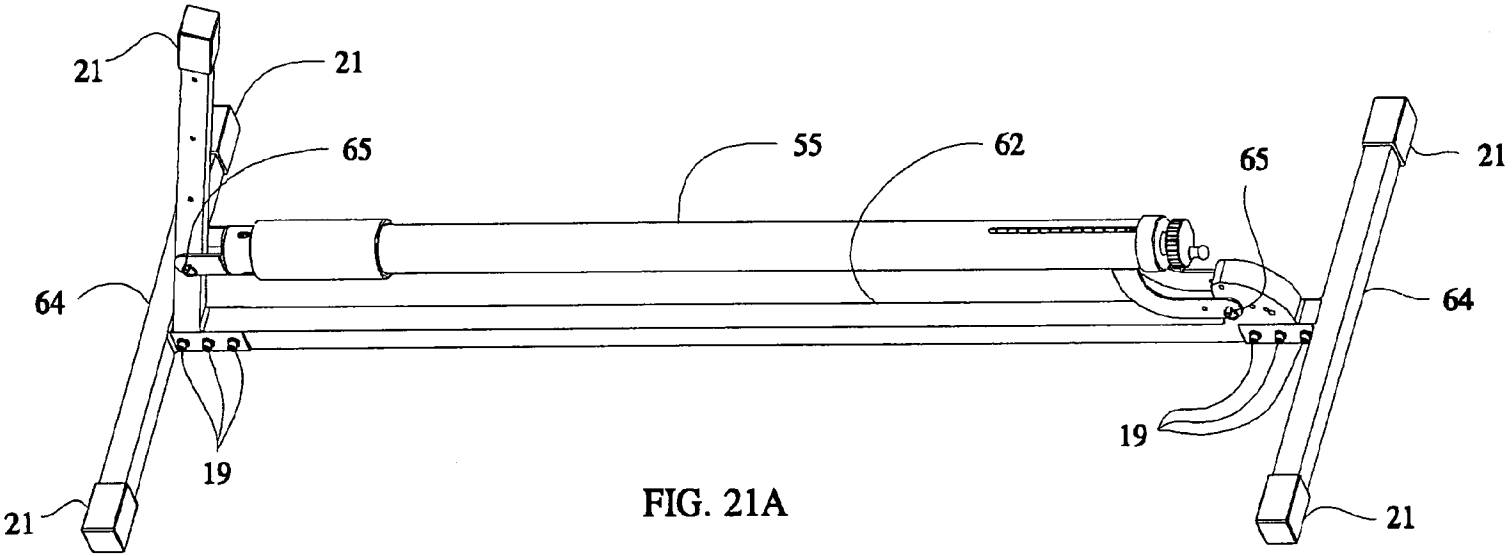
FIG. 21A is a view showing assembled one-sided push-up presses in a perspective view in accordance with the present invention with one-sided bar extending parallel to the base.
Figure 21B:
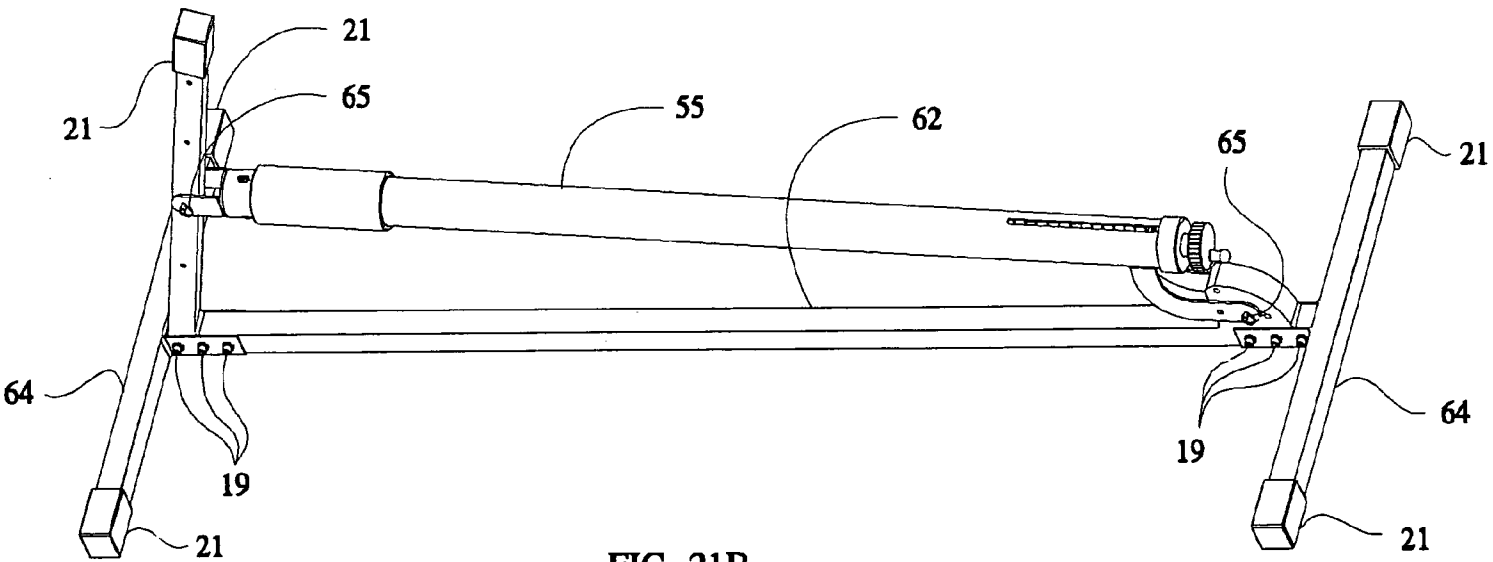
FIG. 21B is a view showing an assembled one-sided push-up press in a perspective view in accordance with the present invention, with one-sided bar arranged angularly to the base.
Figure 21C:
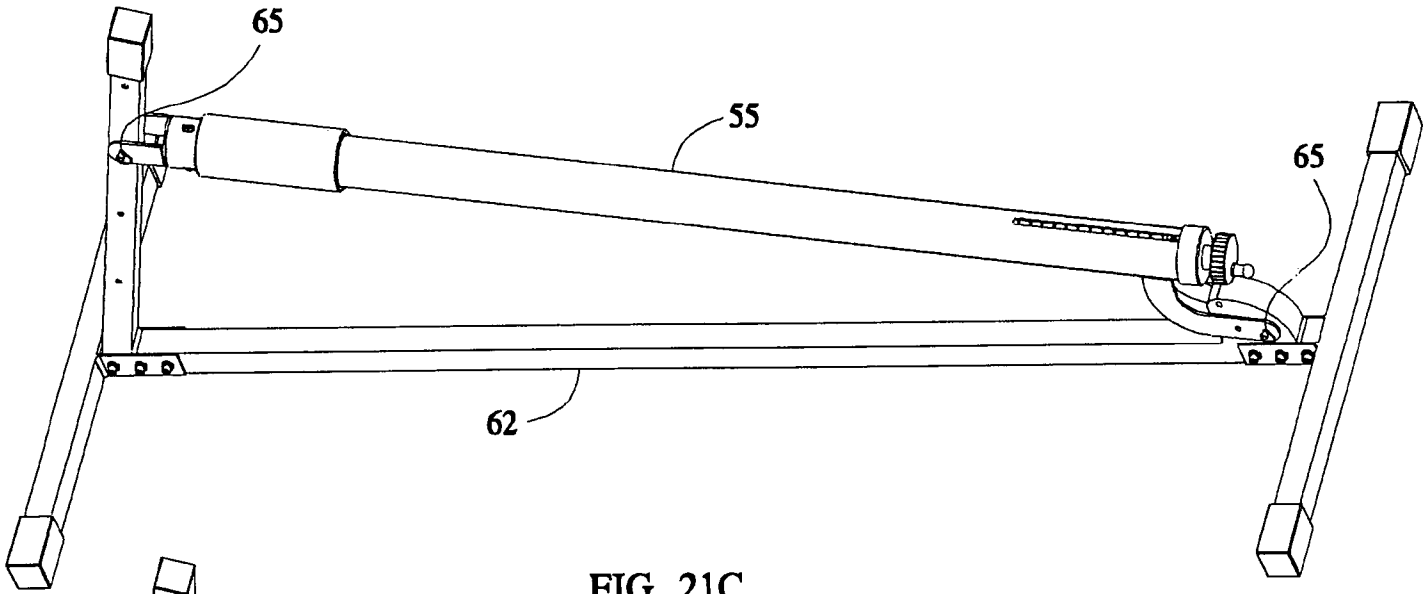
FIG. 21C is a view showing an assembled one-sided push-up press in a perspective view in accordance with the present invention, with one-sided bar having a different angle to the base than shown in FIG. 21B.
Figure 21D:
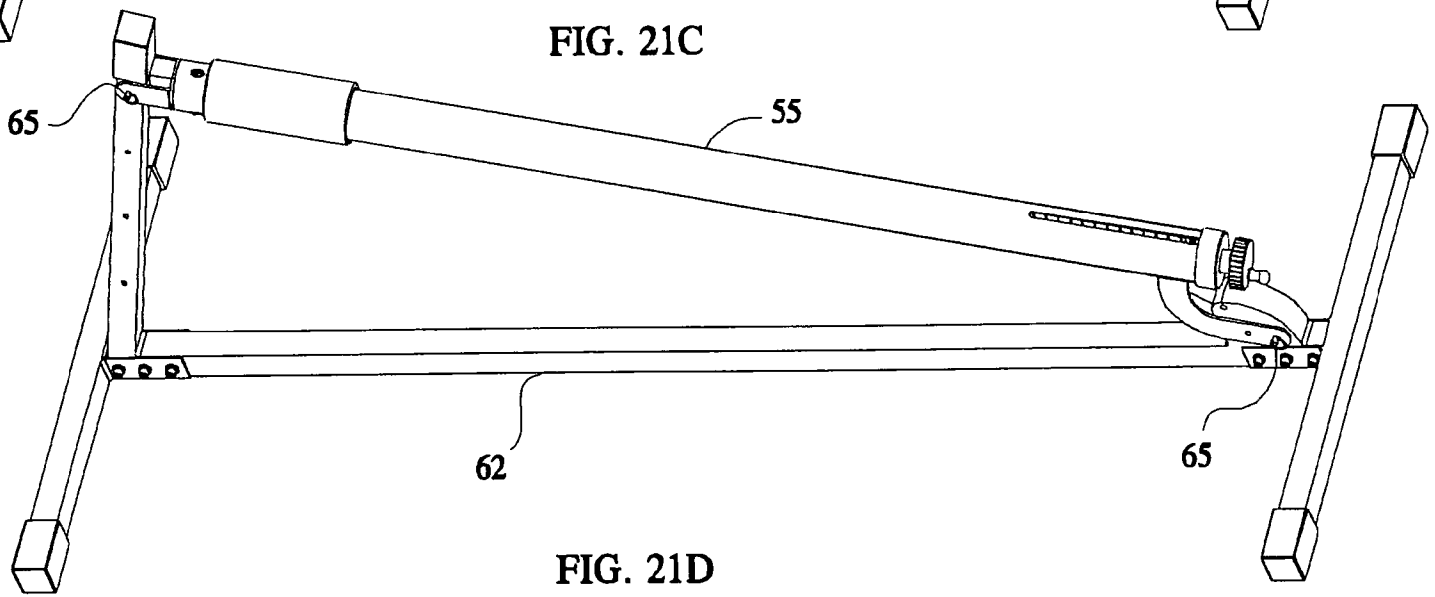
FIG. 21D is a view showing an assembled one-sided push-up press in a perspective view in accordance with the present invention, with one-sided bar having different angles to the base than in FIG. 21C.
Figure 21E:
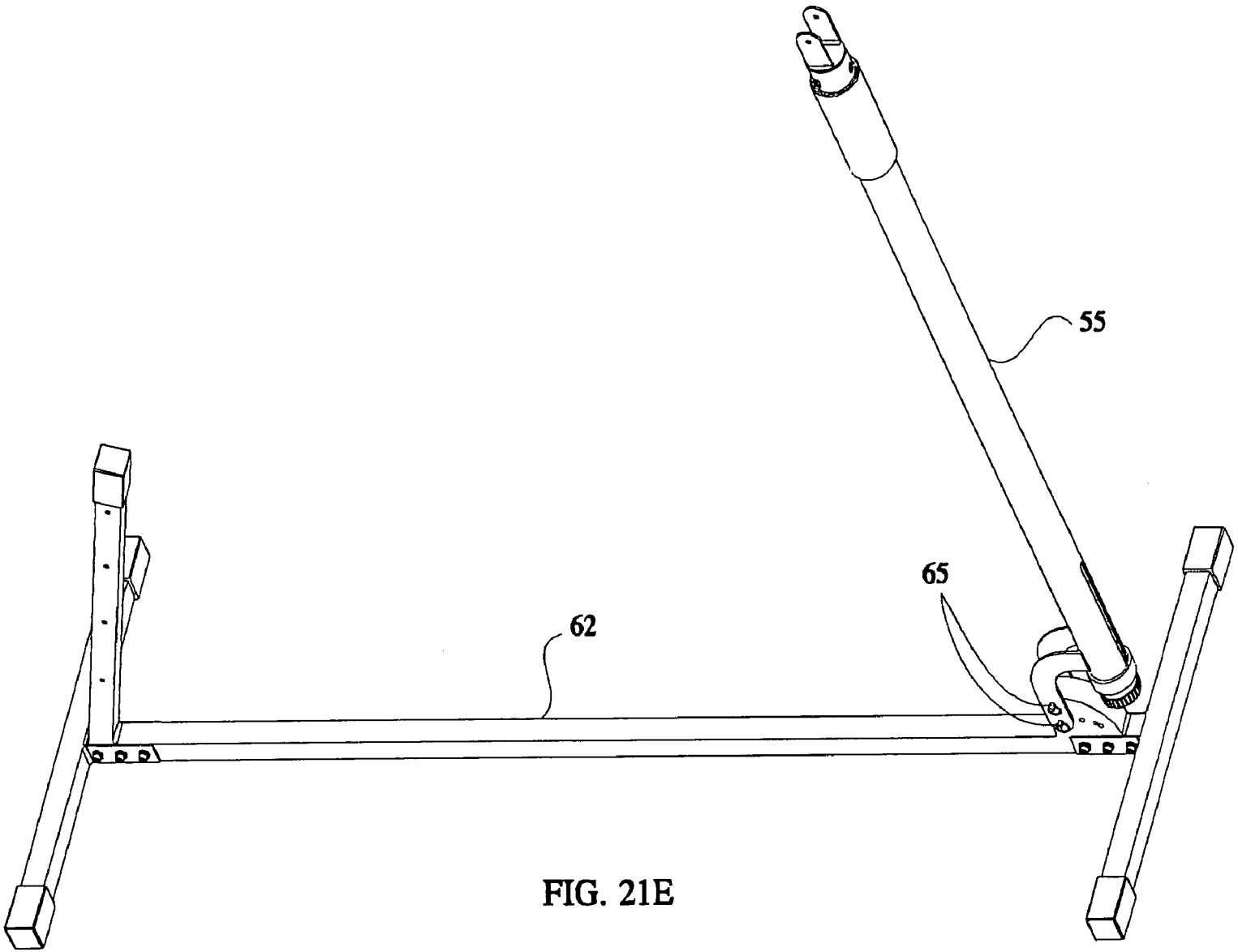
FIG. 21E is a view showing an assembled one-sided push-up press in a perspective view in accordance with the present invention with one-sided bar being normal to the base.
Figure 22:
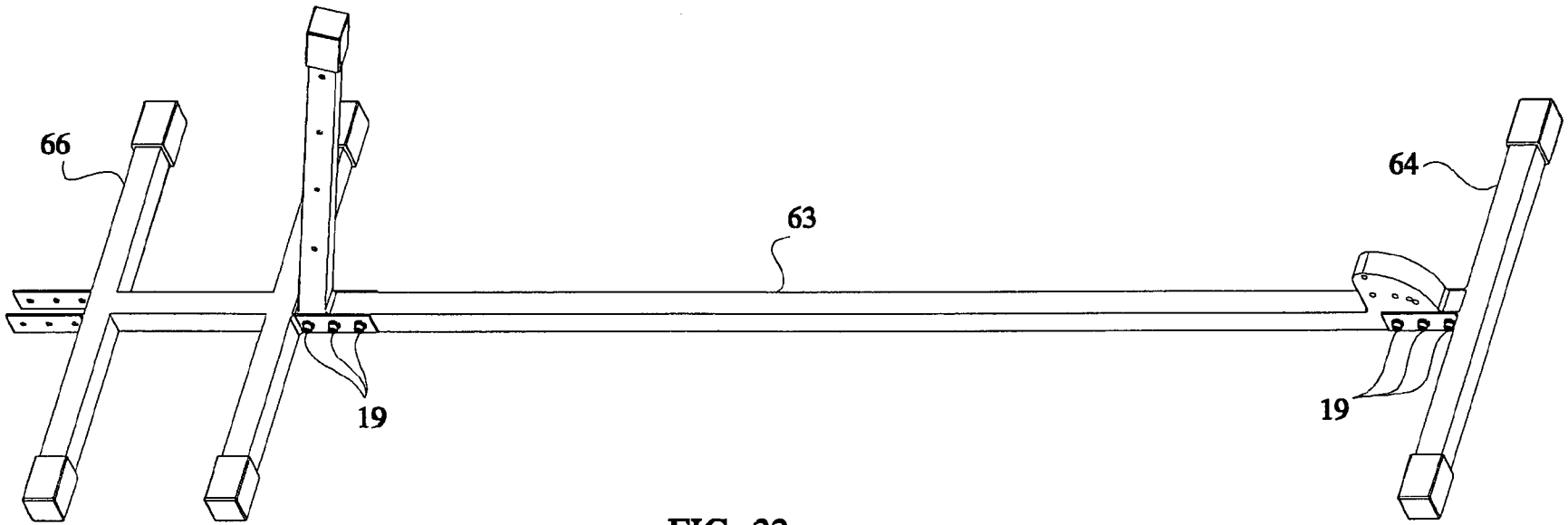
FIG. 22 is a view showing the assembled base for one-sided push-up press with a common central support for the two-sided basis.

A one sided base 62 is used to support the one sided bar 55. The base 62 has a welded rectangular two-pieces bar 63 and horizontal supports 64. The rectangular bar 63 is connected at its ends with identical horizontal supports 64 by screws 19, lock washers 13 and flat washers 14. The horizontal supports 64 are used to impart to the entire base 62 with the bar 55 the needed stability within an exercise time and a space saving advantage during transportation to a store, or to a customer's home. Rubber caps 21, shown in FIGS. 20A and 20B, provided on the ends of horizontal supports 64, operate as an end plugs and as an extra spacers to increase friction between the floor and the base 62.

The one sided bar 55 is secured on the one sided base 62 by two pins 65, which can be inserted in appropriate holes for a desired angular position, as shown on FIG. 21A-FIG. 21E, FIG. 27

Figure 25:
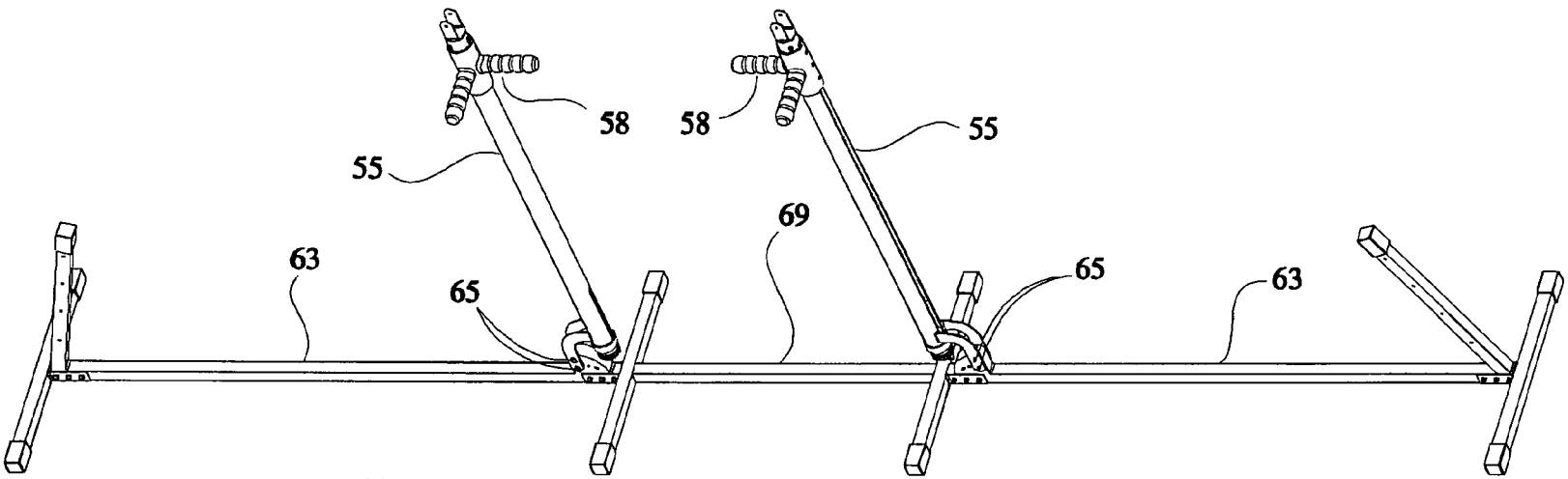
FIG. 25 is a view showing assembled two one-sided push-up presses in a perspective view in accordance with the present invention, with two one-sided bars having a normal position to the base and double handled devices, with the basis having a common long central support.
Figure 27:
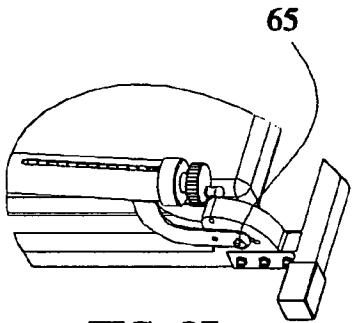
FIG. 27 is a detailed view of FIG. 26 showing a pin installation in accordance with the present invention.

The horizontal support 64 can be modified and used as a common horizontal support 66 for two bases 62, as shown on FIG. 25.

Figure 23A:
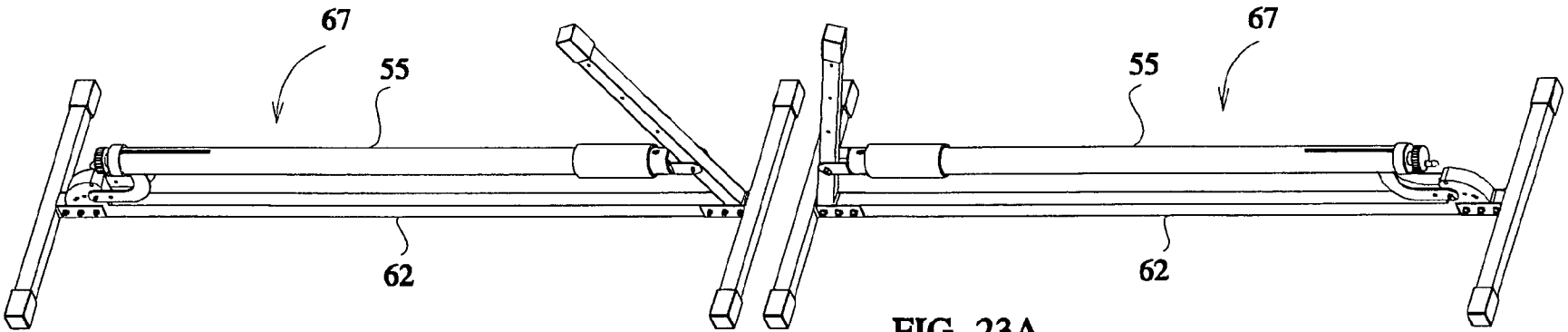
FIG. 23A is a view showing assembled two one-sided push-up presses in a perspective view in accordance with the present invention, with one-sided bars extending parallel to the basis.
Figure 23B:
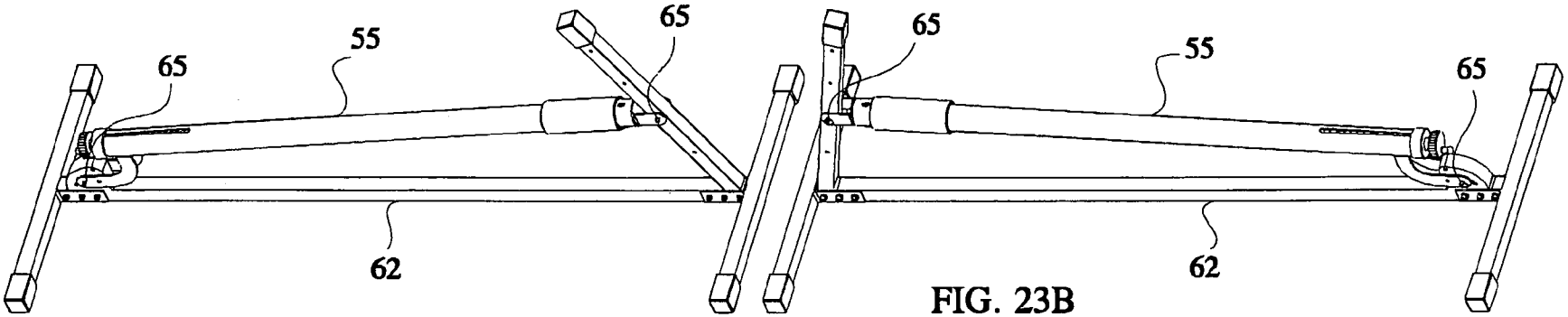
FIGS. 23B-23D are views showing assembled two one-sided push-up presses in a perspective view in accordance with the present invention with one-sided bars having different angular positions with respect to the basis, with the basis extending parallel and located along a common line.
Figure 23C:
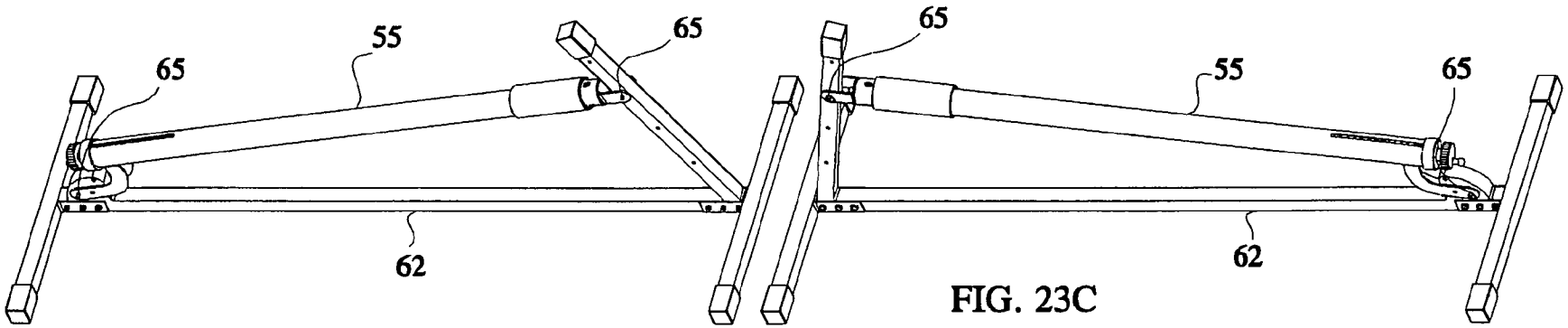
Figure 23D:
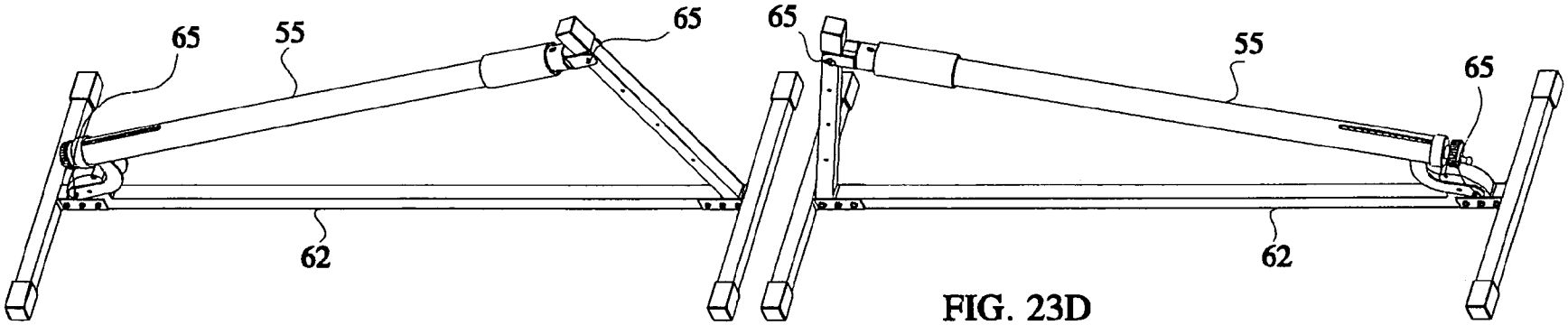
Figure 23E:
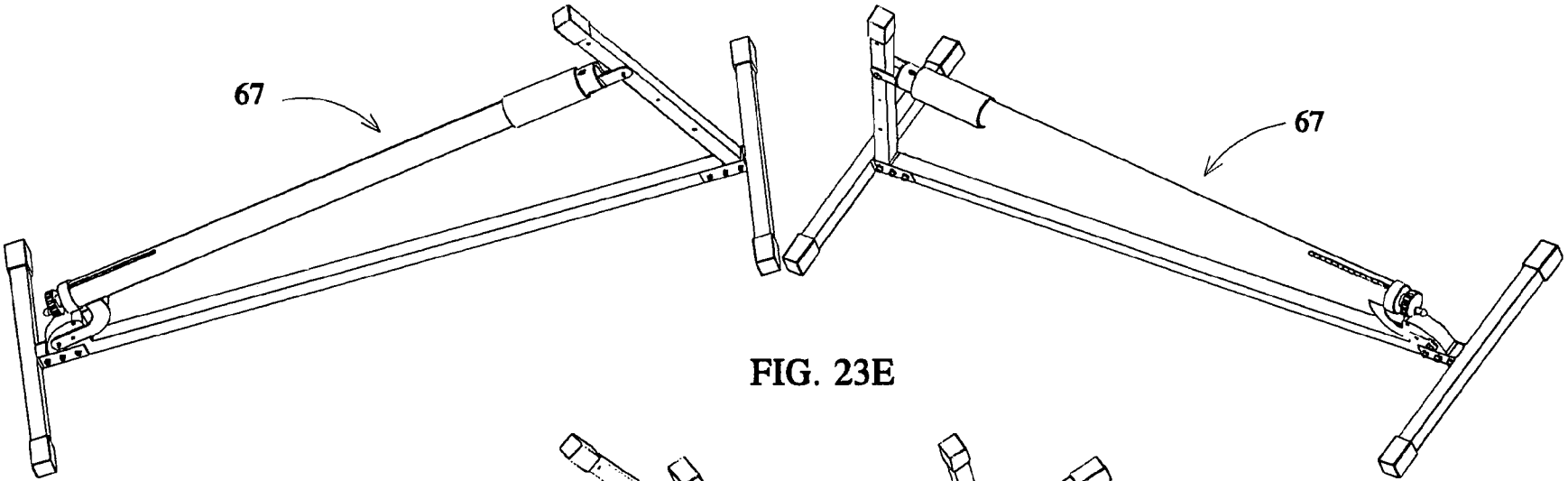
FIGS. 23E-23F are views showing assembled two one-sided push-up presses in a perspective view in accordance with the present invention with one-sided-bars having different angular position with respect to the basis with the basis located under different angles to each other.
Figure 23F:
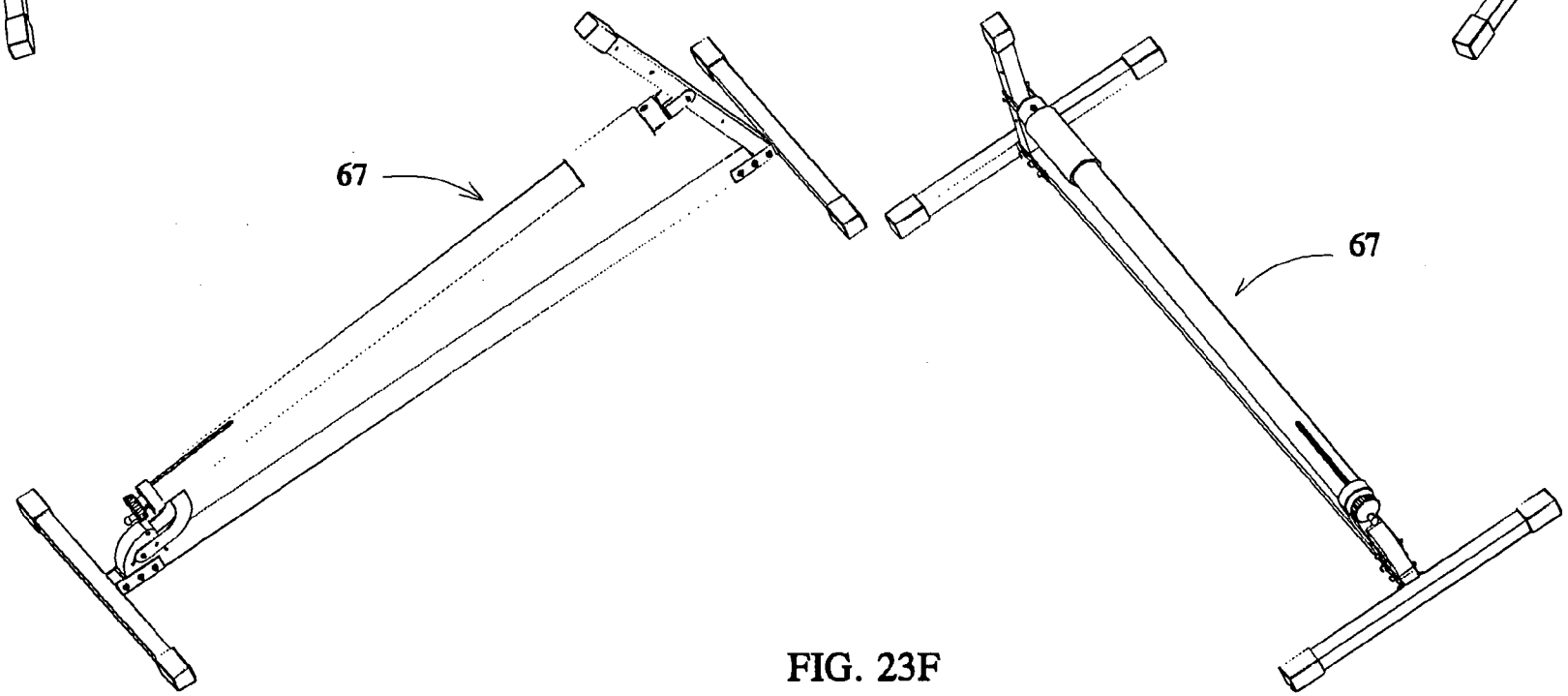
Figure 24A:
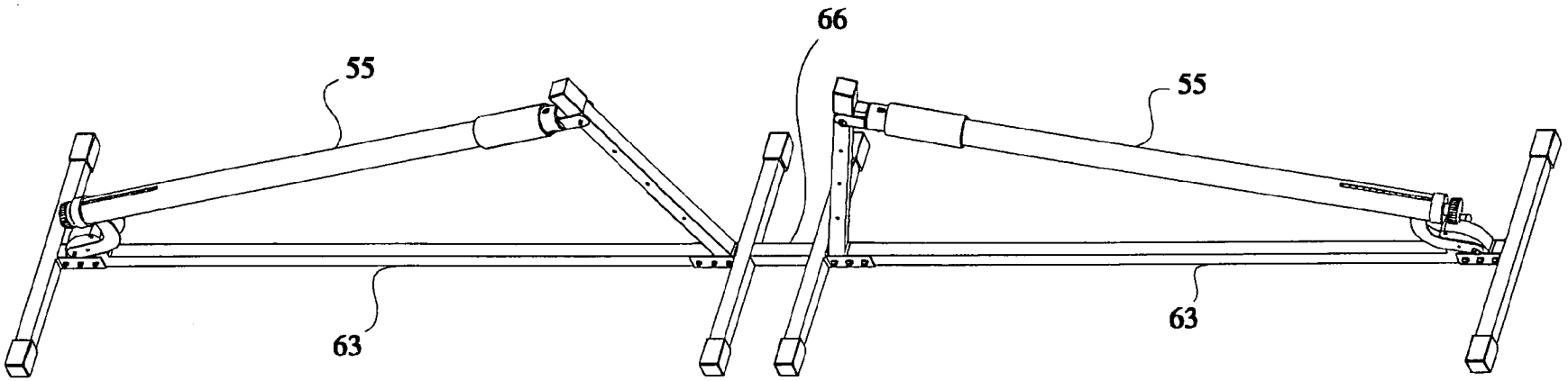
FIG. 24A is a view showing the front assembled two one-sided push-up presses in a perspective view in accordance with the present invention with the basis having a common central support.
Figure 24B:
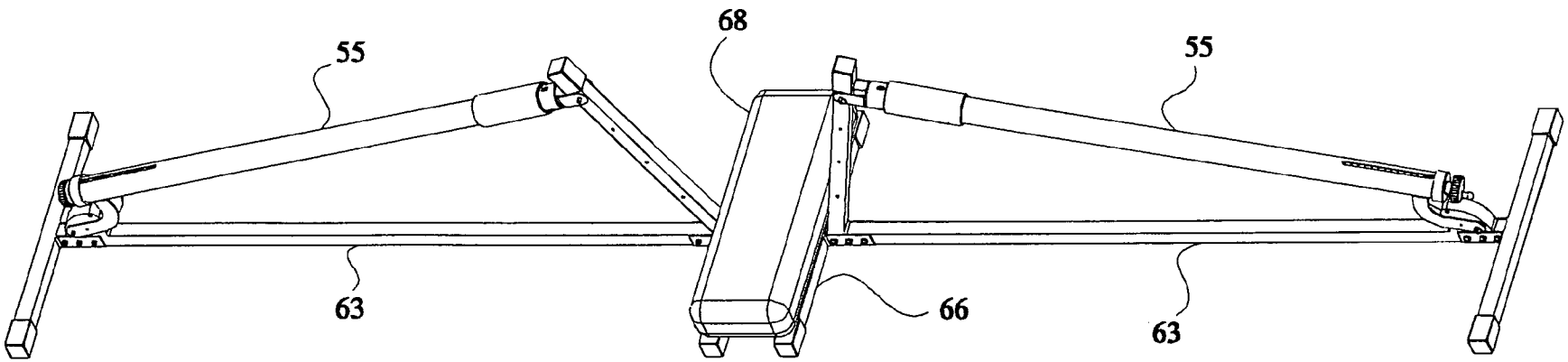
FIG. 24B is a view corresponding to the view of FIG. 24A and showing a common pad for a body support.

A one sided push-up-press 67 can be used as a separate exercise device, or can be used as a double exercise device as shown in FIG. 23A-FIG. 23D. In order to change an angle between the one sided bar 55 and the one sided base 62 user reinserts two pins 65 in appropriate common holes. Each one sided push-up-press 67 could be oriented on a floor in any convenient for user position as shown in FIG. 23E and FIG. 23F, or can be connected to a similar device by common central support 66 as shown in FIG. 24A. For security reason and for convenience on the common central support 66 a common body pad 68 can be installed as shown on FIG. 24B. In this case two one sided push-up-presses 67 will operate as a one piece exercise device shown on FIG. 1.

This is basically the alternate design that duplicates the push-up-press of FIG. 1. This device will train the Pectoral minor and major, with different angles of resistance. It will develop the rhomboids, deltoids and triceps muscles. The body pad 68 enhances safety features for the user. Positioning by a user in between the two handles, the body pad 68 increases comfort while performing on the push-up press 67.

By replacing the common central support 66 with a longer common central support 69, replacing the handles 45 with the double handles 58 and securing one sided bars 55 in vertical position, the user converts the exercise device to another shown on FIG. 25 with different exercise options.

This position will develop the triceps muscles by standing beside the one sided bar 55 and using the handles 45 (or 57, or 58) to press down. This will develop the triceps brachii. Also, by standing in the middle of the two standing bars 55, the user can actually develop the abdominal area by holding the handles 45 (or 57, or 58) with hands and using torso to contract the core muscles. Maintaining the "on user knee position between the two standing bars 55" the user will hold the handles 45 (or 57, or 58) and perform 20 to 50 repetitions of the crunches, using the push-up press handles 45 as a resistance for the core muscles.

Figure 26:
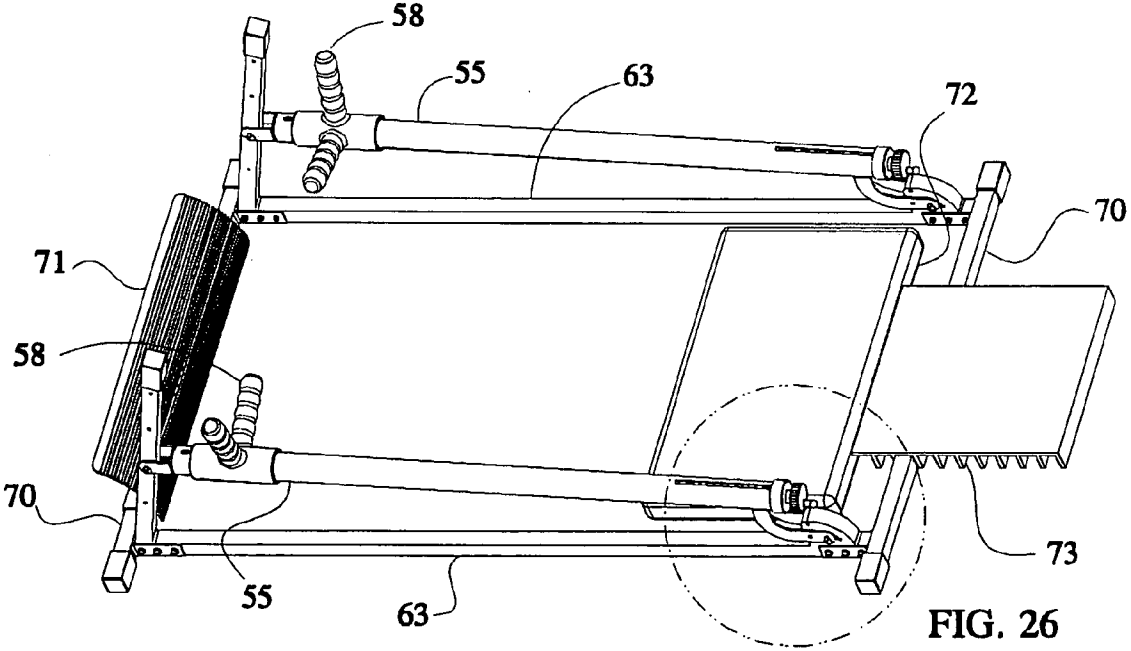
FIG. 26 is a view showing assembled two one-sided push-up presses standing parallel to one another, having a foot support and an adjustable body pad, with basis having a common central supports and double-handled devices.

By replacing the common central supports 64 with a common central supports 70 and relocating bases 63 to parallel position, the user converts the exercise device shown on FIG. 24A into the device shown on FIG. 26 with the different exercise option. In this case feet support 71 is installed on one common support 70 and adjustable body pad 72 with ridge 73 is installed on another common support 70. The pin 65 as shown on FIG. 27 will secure the one sided bar 55 in an appropriate position.

The positioning of the device has direct repercussion on the muscles developed. In this format, the user sits between the bars 55 located parallel to each other and the handles 45 (or 57, or 58) are located across each other. This position will require the user to hold the handles 45 (or 57, or 58) and to bring them towards him to effectively develop the back muscle. This device is also considered as a row machine.

Figure 28A:
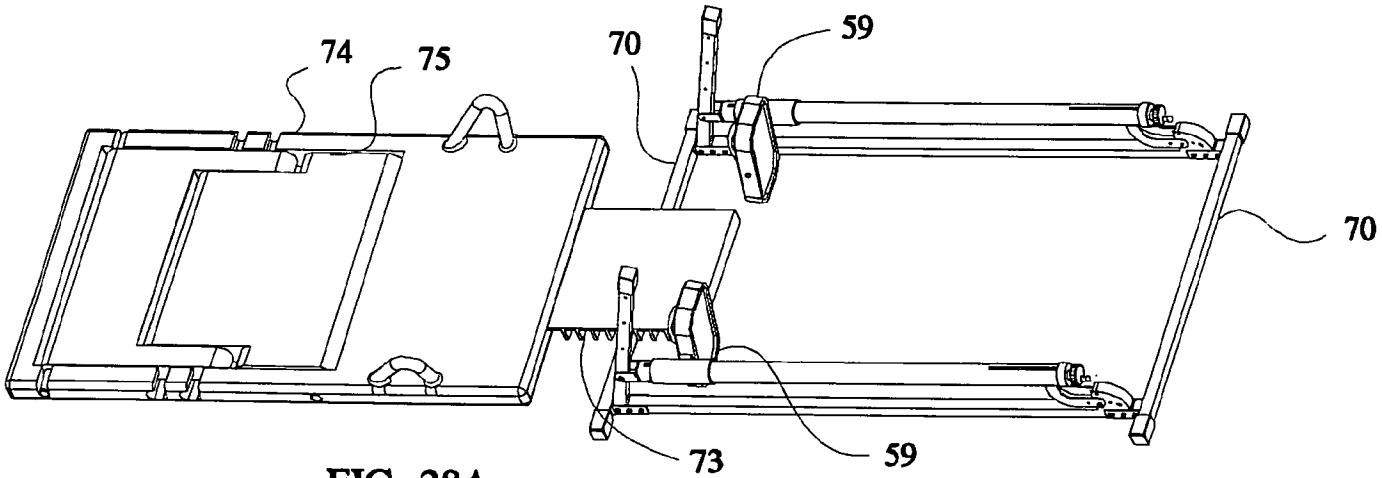
FIG. 28A is a perspective view showing an assembled two one-sided push-up presses, extending parallel to one another having an adjustable body pad when adjusted with an adjustable bench, a bench located inside the pad with basis having common central supports with two one-sided bars having feet pedals.
Figure 28B:
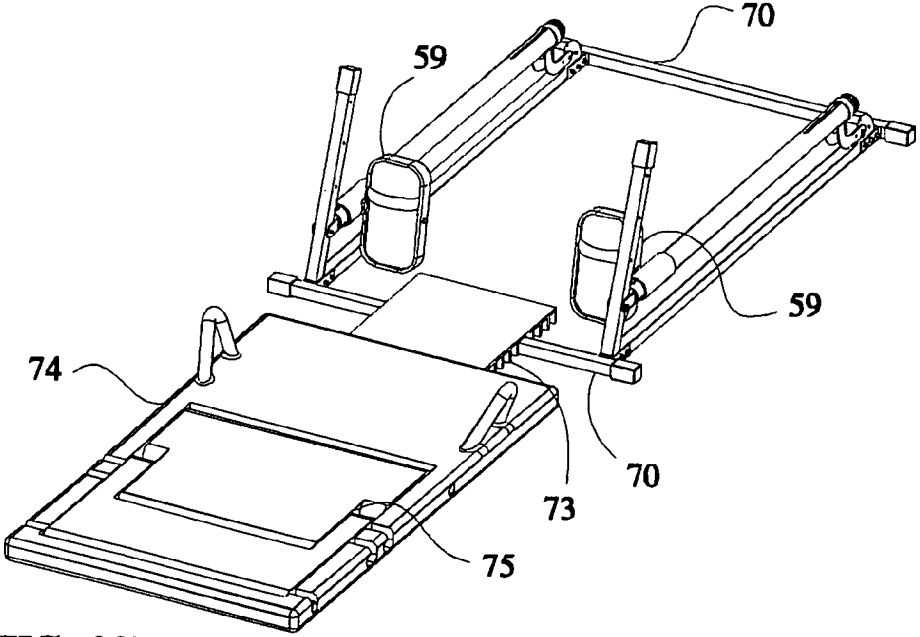
FIG. 28B is a view corresponding to the view of FIG. 28A but as seen from a different perspective point.
Figure 29A:
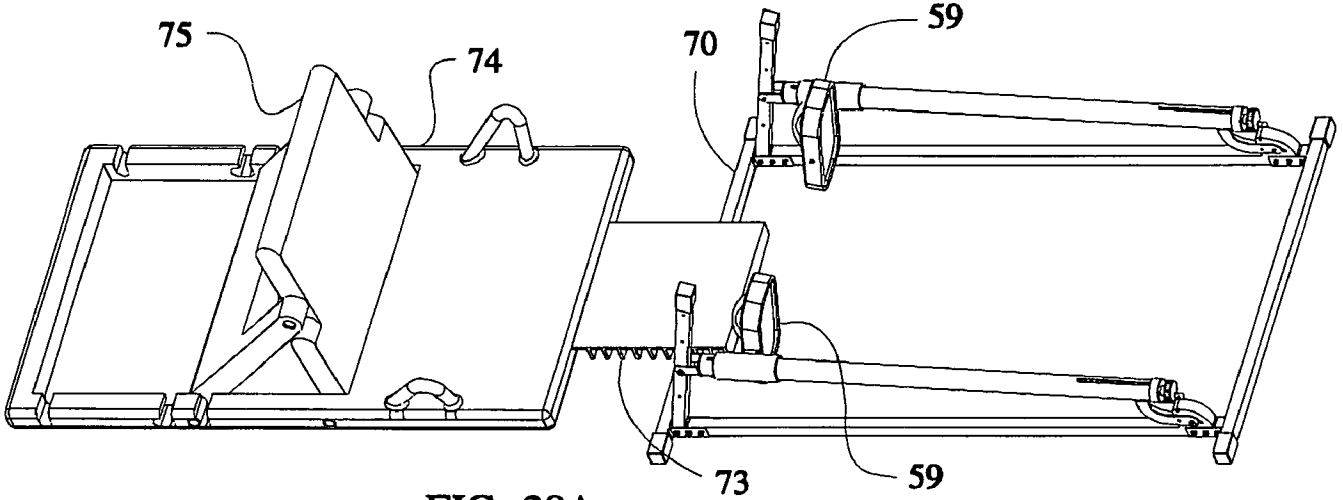
FIG. 29A is a view substantially corresponding to the view of FIG. 28A but showing the bench having an angular position to the body pad.
Figure 29B:
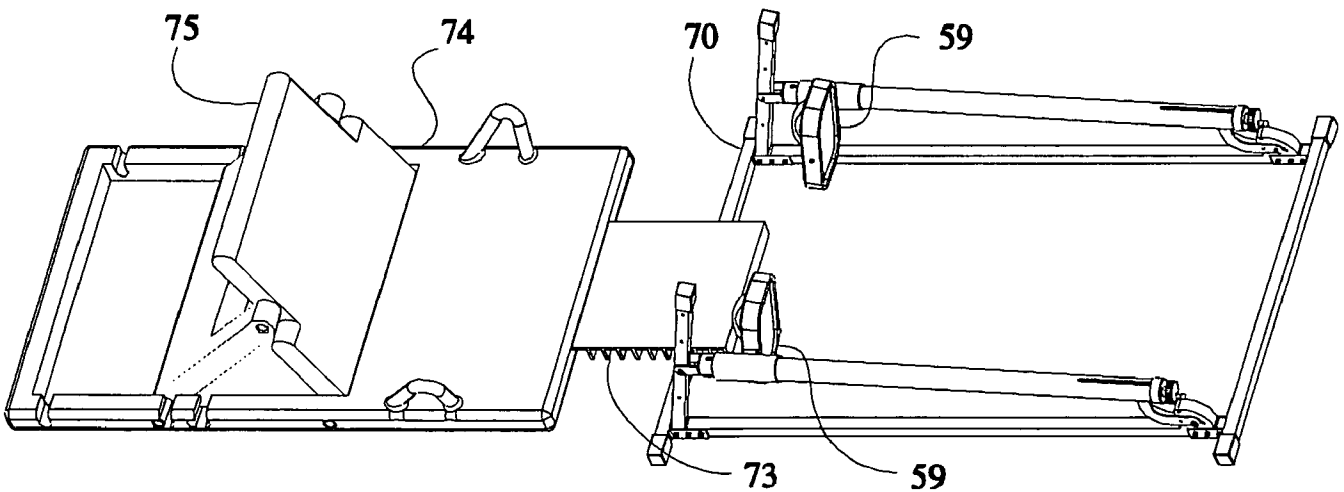
FIG. 29B is a view substantially corresponding to the view of FIG. 29A but showing a bench having a different angular position with respect to the body pad.
Figure 29C:
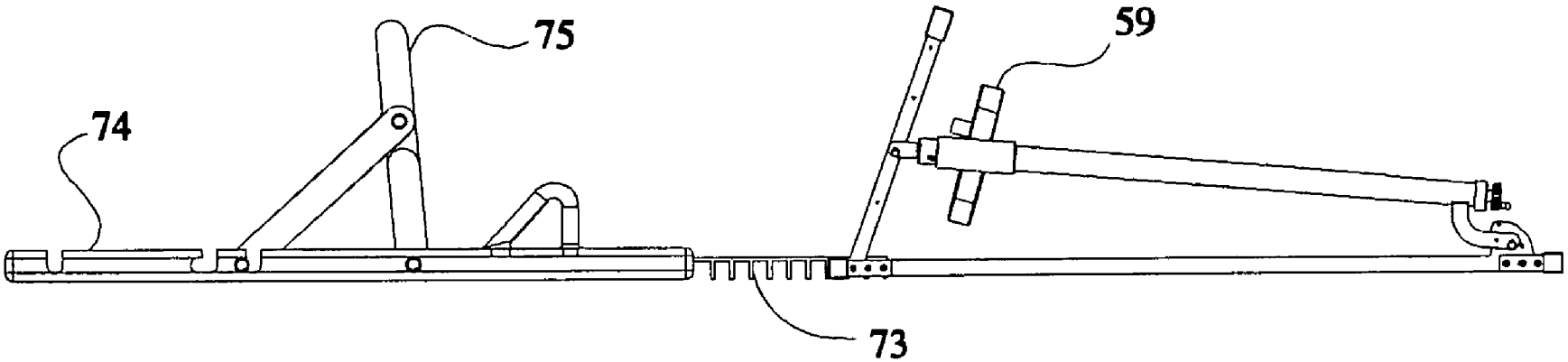
FIG. 29C is a front view of the embodiment shown of the present invention shown in FIG. 29A.
Figure 29D:
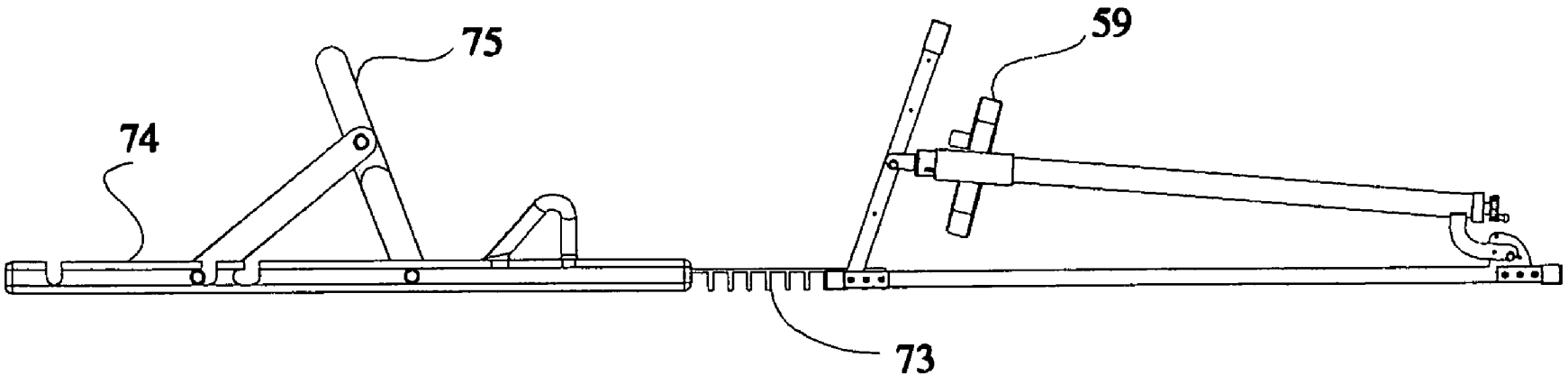
FIG. 29D is a front view of the embodiment shown in FIG. 29B in accordance with the present invention.

In order to exercise legs the body pad 74 is used with the adjustable bench 75 as shown on FIG. 28A and FIG. 28B. The handles 45 or 57 on the one sided bars 55 are replaced with feet pedals 59. In order to adjust the bench 75 the user should simply open and rotate it over a desired angle. In order to adjust the body pad 74 the user inserts a desired ridge 73 into the common central support 70.

The device itself is used as a leg press. The device shown on FIG. 28A-FIG. 29D is the best to use since the user sits down on the bench 75 and uses the bench 75 as a way to maintain the position of the device without its moving while performing the exercise. The handles 45 have added features by replacing with pedals 59 for the feet and use of these pedals 59 to press and create resistance for the legs and to feel the effect of quadriceps training. The user can also use this device to develop gluteus muscles by positioning himself facing the bench 75 and on his knees, using one leg to press the pedals 59 and extending his legs to feel the effect of gluteus exercises. This training device develops the posterior muscles and will increase muscle mass and strength if the user decides to perform squat exercise in the future.

It will be understood that each of the elements described above, or two or more together, may also find a useful application in other types of constructions differing from the type described above.

While the invention has been illustrated and described as embodied in a push-up press, it is not intended to be limited to the details shown, since various modifications and structural changes may be made without departing in any way from the concept and creativity of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A push-up device, comprising a T shaped support frame; comprising a removable single tube extending in one substantially vertical plane, having a center and two opposite ends and being bent from said center so as to form two tubular elements extending from said center at a right side and a left hand side at an angle relative to one another wherein said single tube is removably attached to the support frame at the center and at the respective ends of the tubular elements extending from the center;

two spring means located inside said single tube and each located inside a respective one of said tubular elements to provide a spring resistance along said inclined tubular elements;

two handle means movable by a user outside said single tube over said two inclined tubular elements away from said center along said two inclined tubular elements against the spring resistance of said two spring means so as compress said two spring means in directions away from said center, and so that when said handle means are released by the user said two spring means relax and move said handle means outside said single tube over said two inclined tubular elements back toward said center of said tube;

means for adjusting the spring resistance of said two spring means and including two adjusting elements provided at said opposite ends of said tube and displaceable by a user to move said two spring means toward said center so as to compress said two spring means or away from said center so as to relax said two spring means, and further comprising two protrusions each extending through a respective one of said two tubular elements and connecting a respective one of said two handle means with a respective one of said two spring means to provide a displacement of each of said spring means in said single tube in response to the movement of a corresponding one of each of said two handle means.

2. A push-up device, as defined in claim 1, further comprising two sliding elements provided at opposite ends of each of said two spring means and movable slidingly inside each of said two tubular elements of said single tube.

3. A push-up device as defined in claim 1; said T shaped support frame further comprising support means for supporting said single tube on a support surface and including three support elements with one support element located in a region to support said center of said tube and two support elements located in regions to support said opposite ends of said tube.

4. A push-up device as defined in claim 1, said T shaped support frame further comprising support means for supporting said single tube on a support surface and including a horizontal support element extending in a longitudinal direction of said tube, three substantially vertical support members extending from said substantially horizontal support element in regions of said center and said two opposite ends, and two further support elements extending horizontally in the regions of said opposite ends transversely to said horizontal support element.

5. A push-up device as defined in claim 1; and further comprising indicating means for indicating the spring resistance provided by said two spring means.

6. A push-up device as defined in claim 1, further comprising means for limiting the movement of said handle means over said single tube and including a plurality of through openings provided in said tubular elements and spaced from one another along the latter, and pins insertable into said openings.

7. A push-up device as defined in claim 1, further comprising means for changing an angle between said tube and said support means.

8. A push-up device as defined in claim 1, further comprising a weight means removably supportable on said tube in regions of said opposite ends of said single tube; and means for connecting said weight means to said single tube.

9. A push-up device as defined in claim 8; and further comprising support means for supporting said single tube and including at least two substantially vertical support elements arranged in regions of said opposite ends, so that said tube in one position is supportable on said support elements, and in another position said tube is removed from said support elements and said weight means are placed on said tube in the regions of said opposite ends.

10. A push-up device as defined in claim 1, further comprising a pedal support for supporting feet of the user and an adjustable body pad for supporting a body of a user.

11. A push-up device as defined in claim 1; and further comprising an adjustable bench for maintaining a position during performing an exercise.

12. A push-up device as defined in claim 1, wherein each of said spring means includes at least one spring having two opposite spring ends, and two cylindrical clamps provided at said opposite spring ends and located inside said tube.

13. A push-up device, comprising

T shaped support frame; comprising a removable single tube extending in one substantially vertical plane, having a center and two opposite ends and being bent from said center so as to form two tubular elements extending from said center at a right side and a left hand side at an angle relative to one another wherein said single tube is removably attached to the support frame at the center and at the respective ends of the tubular elements extending from the center;

two spring means located inside said single tube and each located inside a respective one of said tubular elements to provide a spring resistance along said inclined tubular elements;

two handle means movable by a user outside said single tube over said two inclined tubular elements away from said center along said two inclined tubular elements against the spring resistance of said two spring means so as compress said two spring means in directions away from said center, and so that when said handle means are released by the user said two spring means relax and move said handle means outside said single tube over said two inclined tubular elements back toward said center of said tube;

means for adjusting the spring resistance of said two spring means and including two adjusting elements provided at said opposite ends of said tube and displaceable by a user to move said two spring means toward said center so as to compress said two spring means or away from said center so as to relax said two spring means, and further comprising two protrusions each extending through a respective one of said two tubular elements and connecting a respective one of said two handle means with a respective one of said two so ring means to provide a displacement of each of said spring means in said single tube in response to the movement of a corresponding one of each of said two handle means, wherein each of said adjusting means includes crank means for applying a compressing or uncompressing action on a respective one of said two spring means to adjust the resistance of said spring means.

14. A push-up device as defined in claim 13, wherein said supports elements include clamp means configured so that said single tube is placeable into said clamp means and easily liftable from said clamps for using said tube as a non-supported exercising device.

15. A push-up device, comprising a T shaped support frame; comprising a removable single tube extending in one substantially vertical plane, having a center and two opposite ends and being bent from said center so as to form two tubular elements extending from said center at a right side and a left hand side at an angle relative to one another; wherein said singular tube is removably attached to the support frame at the center and at the respective ends of the tubular elements extending from the center two spring means located inside said single tube and each located inside a respective one of said tubular elements to provide a spring resistance along said inclined tubular elements;

two handle means movable by a user outside said single tube over said two inclined tubular elements away from said center along said two inclined tubular elements against the spring resistance of said two spring means so as compress said two spring means in directions away from said center, and so that when said handle means are released by the user said two spring means relax and move said handle means outside said single tube over said two inclined tubular elements back toward said center of said tube; and means for adjusting the spring resistance of said two spring means and including two adjusting elements provided at said opposite ends of said tube and displaceable by a user to move said two spring means toward said center so as to compress said two spring means or away from said center so as to relax said two spring means, wherein each of said handle means includes a sliding cylindrical handle support movable inside said tube, and each of said adjusting means has a cylindrical support located at an opposite end of said at least one spring, wherein said cylindrical handle support is movable in a longitudinal direction toward said cylindrical support member during exercising, while said cylindrical member is movable toward said cylindrical handle support in the longitudinal direction during adjustment.

* * * * *